US011668030B2

(12) United States Patent
Cross et al.

(10) Patent No.: US 11,668,030 B2
(45) Date of Patent: Jun. 6, 2023

(54) ARTICLE WITH AT LEAST TWO SECURABLE INLAID STRANDS

(71) Applicant: NIKE, Inc., Beaverton, OR (US)

(72) Inventors: Tory M. Cross, Portland, OR (US); Daniel A. Podhajny, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 17/558,981

(22) Filed: Dec. 22, 2021

(65) Prior Publication Data

US 2022/0112636 A1 Apr. 14, 2022

Related U.S. Application Data

(63) Continuation of application No. 16/526,445, filed on Jul. 30, 2019, now Pat. No. 11,230,800, which is a (Continued)

(51) Int. Cl.
*D04B 1/24* (2006.01)
*A43B 1/04* (2022.01)
(Continued)

(52) U.S. Cl.
CPC ..... *D04B 1/24* (2013.01); *A43B 1/04* (2013.01); *A43B 23/0265* (2013.01);
(Continued)

(58) Field of Classification Search
CPC . D04B 1/24; D04B 1/102; D04B 7/24; D04B 7/14; D04B 7/28; A43B 1/04; A43B 23/0265; A43B 23/04
See application file for complete search history.

(56) References Cited

U.S. PATENT DOCUMENTS 601,192 A 3/1898 Woodside
782,480 A 2/1905 Benndorf
(Continued)

FOREIGN PATENT DOCUMENTS

CN 101248228 A 8/2008
CN 101583294 A 11/2009
(Continued)

OTHER PUBLICATIONS

"Declaration of Dr. Edward C. Frederick", Inter Partes Review of U.S. Pat. No. 7,347,011, Petitioner adidas AG—Exhibit 1001, 178 pages.

(Continued)

*Primary Examiner* — Danny Worrell
(74) *Attorney, Agent, or Firm* — Shook, Hardy & Bacon L.L.P.

(57) ABSTRACT

The present disclosure, in one aspect, provides an upper for an article of footwear. The upper may include a knitted component. The knitted component may include a knit element, a first tensile strand with an exposed first end, and a second tensile strand with an exposed second end. The first tensile strand may be at least partially inlaid within the knit element, the second tensile strand may be at least partially inlaid within the knit element, and the exposed first end of the first tensile element may be secured to the exposed second end of the second tensile element. One or more braids including tensile strands can be part of a main braid configured to wrap around a heel region of the upper and to be secured to a medial side of the upper.

20 Claims, 21 Drawing Sheets

Related U.S. Application Data continuation of application No. 15/369,379, filed on Dec. 5, 2016, now Pat. No. 10,385,485, which is a continuation of application No. 14/305,169, filed on Jun. 16, 2014, now Pat. No. 9,510,637.

(51) Int. Cl.
*D04B 1/12* (2006.01)
*A43B 23/02* (2006.01)
*A43B 23/04* (2006.01)

(52) U.S. Cl.
CPC ..... *A43B 23/04* (2013.01); *D04B 1/123* (2013.01); *D10B 2501/043* (2013.01)

(56) References Cited

U.S. PATENT DOCUMENTS 1,215,198 A 2/1917 Rothstein
1,597,934 A 8/1926 Stimpson
1,799,016 A 3/1931 Gould
1,888,172 A 11/1932 Joha
1,902,780 A 3/1933 Holden et al.
1,910,251 A 5/1933 Joha
1,972,706 A 9/1934 Engelman
2,001,293 A 5/1935 Wilson
2,047,724 A 7/1936 Zuckerman
2,069,819 A 2/1937 Diem
2,147,197 A 2/1939 Glidden
2,314,098 A 3/1943 McDonald
2,330,199 A 9/1943 Holmes
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,994,322 A 8/1961 Cullen et al.
3,583,081 A 6/1971 Hayashi
3,694,940 A 10/1972 Stohr
3,704,474 A 12/1972 Winkler
3,766,566 A 10/1973 Tadokoro
3,778,856 A 12/1973 Christie et al.
3,859,825 A 1/1975 Foulquies et al.
3,949,570 A 4/1976 Niederer
3,952,427 A 4/1976 von den Benken et al.
3,972,086 A 8/1976 Belli et al.
4,027,402 A 6/1977 Liu et al.
4,031,586 A 6/1977 von den Benken et al.
4,036,037 A 7/1977 Huckfeldt
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A 5/1984 Zaino
4,465,448 A 8/1984 Aldridge
4,607,439 A 8/1986 Sogabe et al.
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,149,583 A 9/1992 Saarikettu
5,152,025 A 10/1992 Hirmas
5,192,601 A 3/1993 Neisler
5,299,435 A 4/1994 Whalley
5,345,638 A 9/1994 Nishida
5,353,524 A 10/1994 Brier
5,371,957 A 12/1994 Gaudio
5,416,961 A 5/1995 Vinay
5,461,884 A 10/1995 McCartney et al.
5,511,323 A 4/1996 Dahlgren
5,512,354 A 4/1996 Scholz et al.
5,572,860 A 11/1996 Mitsumoto et al.
5,575,090 A 11/1996 Condini
5,623,840 A 4/1997 Roell
5,706,677 A 1/1998 Matsuda
5,729,918 A 3/1998 Smets
5,735,145 A 4/1998 Pemick
5,746,013 A 5/1998 Fay, Sr.
5,765,296 A 6/1998 Ludemann et al.
5,765,400 A 6/1998 Roell
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,082,148 A 7/2000 Wakai et al.
6,088,936 A 7/2000 Bahl
6,151,802 A 11/2000 Reynolds
6,151,922 A 11/2000 Shimasaki
6,170,175 B1 1/2001 Funk
6,308,438 B1 10/2001 Throneburg et al.
6,333,105 B1 12/2001 Tanaka et al.
6,401,364 B1 6/2002 Burt
6,558,784 B1 5/2003 Norton et al.
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 8/2005 Dua
6,939,372 B2 9/2005 Dong
6,984,596 B2 1/2006 Dickerson
D517,297 S 3/2006 Jones et al.
7,051,460 B2 5/2006 Orei et al.
7,056,402 B2 6/2006 Koerwien et al.
7,201,024 B2 4/2007 Hirayama et al.
7,347,011 B2 3/2008 Dua et al.
7,441,348 B1 10/2008 Dawson
7,543,397 B2 6/2009 Kilgore et al.
7,549,303 B2 6/2009 Callaway et al.
7,568,298 B2 8/2009 Kerns
7,682,219 B2 3/2010 Falla
8,132,340 B2 3/2012 Meschter
8,448,474 B1 5/2013 Tatler et al.
8,490,299 B2 7/2013 Dua et al.
8,505,220 B2 8/2013 James et al.
9,095,186 B2 8/2015 Follet
9,226,548 B2 * 1/2016 Follet ..... D04B 21/20
9,301,567 B2 4/2016 Dealey et al.
9,510,637 B2 * 12/2016 Podhajny ..... D04B 1/24
9,661,892 B2 5/2017 Meir
9,803,299 B2 10/2017 Podhajny
9,848,672 B2 12/2017 Podhajny
9,936,757 B2 4/2018 Podhajny
10,385,485 B2 * 8/2019 Cross ..... D04B 1/123
11,230,800 B2 * 1/2022 Cross ..... D04B 1/24
2002/0078599 A1 6/2002 Delgorgue et al.
2002/0148258 A1 10/2002 Cole et al.
2003/0126762 A1 7/2003 Tseng
2003/0191427 A1 10/2003 Jay et al.
2004/0118018 A1 6/2004 Dua
2004/0181972 A1 9/2004 Csorba
2005/0115284 A1 6/2005 Dua
2005/0193592 A1 9/2005 Dua et al.
2005/0273988 A1 12/2005 Christy
2005/0284000 A1 12/2005 Kerns
2006/0059715 A1 3/2006 Aveni
2006/0162187 A1 7/2006 Byrnes et al.
2007/0022627 A1 2/2007 Sokolowski et al.
2007/0180730 A1 8/2007 Greene et al.
2007/0294920 A1 12/2007 Baychar
2008/0017294 A1 1/2008 Bailey et al.
2008/0078102 A1 4/2008 Kilgore et al.
2008/0110048 A1 5/2008 Dua et al.
2008/0189830 A1 8/2008 Egglesfield
2008/0313939 A1 12/2008 Ardill
2009/0068908 A1 3/2009 Hinchcliff

(56) References Cited

U.S. PATENT DOCUMENTS

| | | | |
|---|---|---|---|
| 2010/0051132 | A1 | 3/2010 | Glenn |
| 2010/0154256 | A1 | 6/2010 | Dua |
| 2010/0170651 | A1 | 7/2010 | Scherb et al. |
| 2011/0030244 | A1 | 2/2011 | Motawi et al. |
| 2011/0041359 | A1 | 2/2011 | Dojan et al. |
| 2011/0078921 | A1 | 4/2011 | Greene et al. |
| 2012/0233882 | A1 | 9/2012 | Huffa et al. |
| 2012/0255201 | A1 | 10/2012 | Little |
| 2012/0279260 | A1 | 11/2012 | Dua et al. |
| 2013/0219636 | A1 | 8/2013 | Dojan et al. |
| 2014/0068968 | A1 | 3/2014 | Podhajny et al. |
| 2014/0130373 | A1 | 5/2014 | Baines et al. |
| 2014/0137434 | A1 | 5/2014 | Craig |
| 2014/0150292 | A1 | 6/2014 | Podhajny et al. |
| 2014/0245633 | A1 | 9/2014 | Podhajny |
| 2015/0359290 | A1 | 12/2015 | Podhajny et al. |
| 2017/0079366 | A1 | 3/2017 | Cross et al. |
| 2019/0352815 | A1 | 11/2019 | Cross et al. |

FOREIGN PATENT DOCUMENTS

| | | | |
|---|---|---|---|
| CN | 203182148 | U | 9/2013 |
| CN | 103393256 | A | 11/2013 |
| CN | 103517647 | A | 1/2014 |
| CN | 203399745 | U | 1/2014 |
| CN | 103841851 | A | 6/2014 |
| CN | 106659269 | A | 5/2017 |
| DE | 870963 | | 3/1953 |
| DE | 1084173 | | 6/1960 |
| DE | 19738433 | A1 | 4/1998 |
| DE | 19728848 | A1 | 1/1999 |
| EP | 0090580 | A1 | 10/1983 |
| EP | 0279950 | A2 | 8/1988 |
| EP | 0448714 | A1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 2649898 | A1 | 10/2013 |
| FR | 2171172 | | 9/1973 |
| GB | 538865 | | 8/1941 |
| GB | 2018837 | A | 10/1979 |
| GB | 1603487 | | 11/1981 |
| JP | 6-113905 | A | 4/1994 |
| JP | 8-109553 | A | 4/1996 |
| JP | 11-302943 | A | 11/1999 |
| JP | 2013-502301 | A | 1/2013 |
| JP | 2014-508009 | A | 4/2014 |
| NL | 7304678 | | 10/1974 |
| WO | 90/03744 | A1 | 4/1990 |
| WO | 98/43506 | A1 | 10/1998 |
| WO | 00/32861 | A1 | 6/2000 |
| WO | 02/31247 | A1 | 4/2002 |

OTHER PUBLICATIONS

Eberle et al., "Clothing Technology", Sixth German Edition and Third English Edition, Petitioner adidas AG—Exhibit 1013, 2002, 3 pages.

Spencer, David J., "Knitting Technology—A Comprehensive Handbook and Practical Guide", Third Edition, Woodhead Publishing Limited, Petitioner adidas AG—Exhibit 1012, 2001, 413 pages.

Office Action received for European Patent Application No. 18167267.6, dated Mar. 28, 2022, 4 pages.

Office Action received for European Patent Application No. 18167267.6, dated Nov. 9, 2022, 5 pages.

* cited by examiner

ARTICLE WITH AT LEAST TWO SECURABLE INLAID STRANDS

CROSS-REFERENCE TO RELATED APPLICATIONS

This application is a continuation of, and claims priority to, U.S. patent application Ser. No. 16/526,445, filed Jul. 30, 2019, and issued on Jan. 25, 2002 as U.S. Pat. No. 11,230,800, which is a continuation of U.S. patent application Ser. No. 15/369,379, filed Dec. 5, 2016, and issued on Aug. 20, 2019 as U.S. Pat. No. 10,385,485, which is a continuation of U.S. patent application Ser. No. 14/305,169, filed Jun. 16, 2014, and issued on Dec. 6, 2016 as U.S. Pat. No. 9,510,637, which is incorporated by reference herein in their entireties.

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart elasticity, wear-resistance, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

An article is disclosed that includes a knitted component formed of unitary knit construction. The knitted component includes a knit element that is configured to stretch between a neutral position and a stretched position. The knitted component also includes a tensile strand that is formed of unitary knit construction with the knit element. The tensile strand is at least partially inlaid within the knit element. The tensile strand includes a portion that is arranged as a stretch limiter element that is configured to move between a slack position and a taut position as the knit element moves between the neutral position and the stretched position. The stretch limiter element is in the slack position when the knit element is in the neutral position, and the stretch limiter element is in the taut position when the knit element is in the stretched position to prevent stretch of the knit element beyond the stretched position.

Also, an article is disclosed that includes a knitted component formed of unitary knit construction. The knitted component includes a knit element with a first portion and a second portion. The first portion is stretchable relative to the second portion between a neutral position and a stretched position. The knitted component also includes a tensile strand that is formed of unitary knit construction with the knit element. The tensile strand extends across at least one of the first portion and the second portion of the knit element. The tensile strand is at least partially inlaid within the knit element. The tensile strand includes a portion that is arranged as a stretch limiter element that is configured to move between a slack position and a taut position as the first portion stretches between the neutral position and the stretched position. The stretch limiter element is in the slack position when the first portion is in the neutral position. The stretch limiter element is in the taut position when the first portion is in the stretched position to prevent stretch of the first portion beyond the stretched position.

Moreover, an article is disclosed that includes a knitted component formed of unitary knit construction. The knitted component includes a knit element that includes a first portion and a second portion. The first portion and the second portion are both stretchable. The knitted component also includes a first tensile strand that is at least partially inlaid within the knit element and that is configured to limit a range of stretching motion of the first portion. The first tensile strand includes a portion that is arranged as a first stretch limiter element that is configured to move between a slack position and a taut position as the first portion stretches. The knitted component also includes a second tensile strand that is at least partially inlaid within the knit element and that is configured to limit a range of stretching motion of the second portion. The second tensile strand includes a portion that is arranged as a second stretch limiter element that is configured to move between a slack position and a taut position as the second portion stretches. The first stretch limiter element, in the slack position, is configured to allow stretch of the first portion. The first stretch limiter element, in the taut position, is configured to prevent stretch of the first portion. The second stretch limiter element, in the slack position, is configured to allow stretch of the second portion. The second stretch limiter element, in the taut position, is configured to prevent stretch of the second portion.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Example embodiments will now be described more fully with reference to the accompanying drawings.

The following discussion and accompanying figures disclose a variety of concepts related to a knitted component.

The knitted component can be incorporated into a wide variety of articles, such as an article of footwear, an article of apparel, sports equipment, and other objects.

The knitted component can include various features that allow stretching of one or more areas of the knitted component. The knitted component can stretch, for example, to fit and conform to an underlying surface. More specifically, in some embodiments, the knitted component can be incorporated into an article of footwear, and the knitted component can stretch to fit and conform to the wearer's foot. Also, the joints in the foot can articulate, the musculature of the foot can flex, and/or the foot can otherwise move to cause stretching of the knitted component. Moreover, the footwear can impact the ground, a ball, or other object, and the resulting forces can cause stretching of the knitted component. Thus, the knitted component can stretch to remain comfortably secured to the wearer's foot.

Additionally, in some embodiments, the knitted component can include one or more features that limit the stretching of the knitted component. For example, one or more features of the knitted component can prevent the knitted component from stretching beyond a predetermined dimension. Thus, in some embodiments, the amount of stretching of the knitted component can be limited such that the footwear remains secured to the foot and continues to support the foot.

Moreover, in some embodiments, the knitted component can be adjustable to vary the available range of stretching motion of the knitted component. For example, in a first configuration, the knitted component can stretch within a first range of motion, and in a second configuration, the knitted component can stretch within a second, smaller range of motion. As such, the user can select the amount of stretchability of the knitted component.

FIGS. 1-4 illustrate these features generally according to exemplary embodiments of the present disclosure. It will be appreciated, however, that the knitted component can vary from these embodiments without departing from the scope of the present disclosure.

Figure 1:
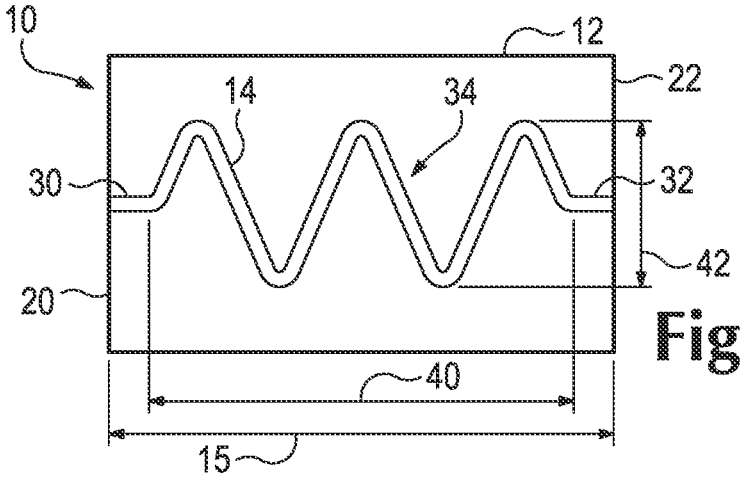
FIG. 1 is a schematic plan view of a knitted component with a knit element and a stretch limiter element, wherein the stretch limiter element is shown in a first slack position.

FIG. 1 shows a knitted component 10 according to an exemplary embodiment. Knitted component 10 can generally include a knit element 12 and a tensile strand 14. Knit element 12 can be attached to tensile strand 14.

Knit element 12 can include one or more yarns or strands that are joined through knitting to form a knit textile, for example, in the configuration of a textile sheet. Knit element 12 can include a first boundary 20 and a second boundary 22. For example, boundary 20 and boundary 22 can be defined at respective edges of knitted component 10. In other embodiments, boundary 20 and/or boundary 22 can be spaced inboard from the edges of knitted component 10.

Figure 2:
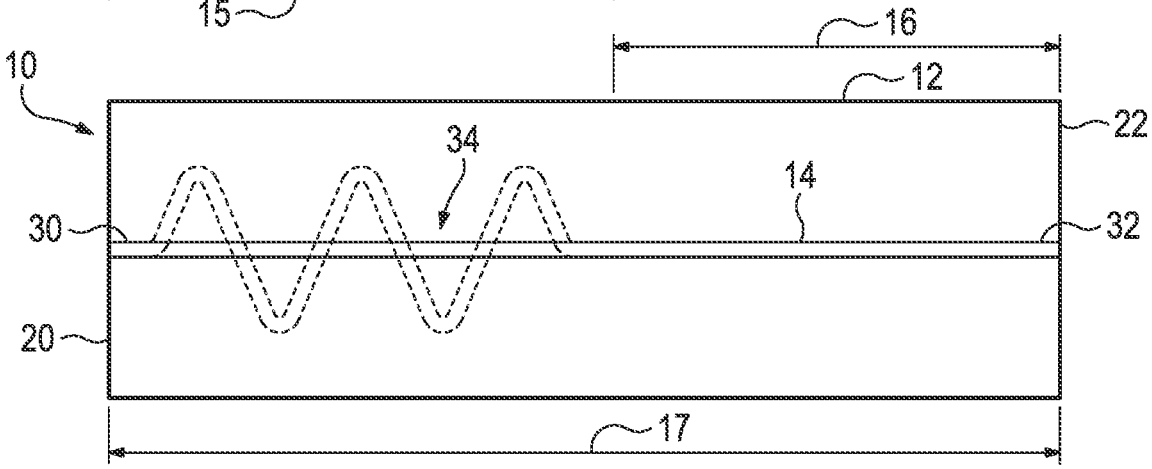
FIG. 2 is a schematic plan view of the knitted component of FIG. 1, wherein the stretch limiter element is shown in a taut position to prevent further stretching of the knit element.

Knit element 12 can be stretchable in some embodiments. In some cases, knit element 12 may be formed with a yarn or strand that is configured to stretch, such as an elastic yarn. In other cases, knit element 12 may be made stretchable by the knit structure used to form the knit element 12. For example, as shown in FIG. 2, knit element 12 can stretch such that second boundary 22 moves away from first boundary 20. Thus, knit element 12 can have a neutral position shown in FIG. 1 and can stretch to a stretched position shown in FIG. 2. Also, knit element 12 can have a range of stretching motion that is indicated at 16 in FIG. 2.

More specifically, knit element 12 can have a first width 15 in the neutral position of FIG. 1 measured between first boundary 10 and second boundary 22. Knit element 12 can also have a second width 17 when in the stretched position of FIG. 2. Range of stretching 16 is shown in FIG. 2 as the difference between first width 15 and second width 17. It will be appreciated that the one-dimensional type of stretching shown in FIGS. 1 and 2 is merely an example and that knit element 12 can be configured to stretch in different ways without departing from the scope of the present disclosure.

Tensile strand 14 can be a yarn, a cable, a rope, or other strand. Tensile strand 14 can include a first end 30 and a second end 32. In some embodiments, tensile strand 14 can be flexible, but tensile strand 14 can have a substantially fixed length measured from first end 30 to second end 32. Stated differently, tensile strand 14 can be substantially inelastic. Thus, knit element 12 can be more stretchable than tensile strand 14.

Tensile strand 14 can extend across knit element 12. For example, tensile strand 14 can extend from first boundary 20 to second boundary 22 in some embodiments. In some embodiments, tensile strand 14 can be at least partially inlaid within knit element 12. Also, in some embodiments, portions of tensile strand 14 can be exposed from knit element 12.

Tensile strand 14 can limit the stretching of knit element 12. For example, at least a portion of tensile strand 14 can provides a stretch limiter element 34 for knitted component 10. Stretch limiter element 34 can be included between first end 30 and second end 32. Stretch limiter element 34 can control stretching of knit element 12.

More specifically, in some embodiments, stretch limiter element 34 can have a slack position as represented in FIG. 1. Stretch limiter element 34 can also have a taut position as represented in FIG. 2. Thus, tensile strand 14 can be relatively slack and can have relatively low tension when knit element 12 is in the neutral position represented in FIG. 1. In contrast, tensile strand 14 can be substantially taut and can have relatively high tension when knit element 12 is in the stretched position represented in FIG. 2. At the taut position, tensile strand 14 can prevent knit element 12 from stretching further than the position shown in FIG. 2. More specifically, in some embodiments, the inelasticity of tensile strand 14 can stop knit element 12 from continuing to stretch beyond the predetermined position associated with the stretched position shown in FIG. 2.

Also, in some embodiments, stretch limiter element 34 of tensile strand 14 can be adjustable. Adjustment of stretch limiter element 34 can vary the range of stretching motion of knitted component 10.

Figure 3:
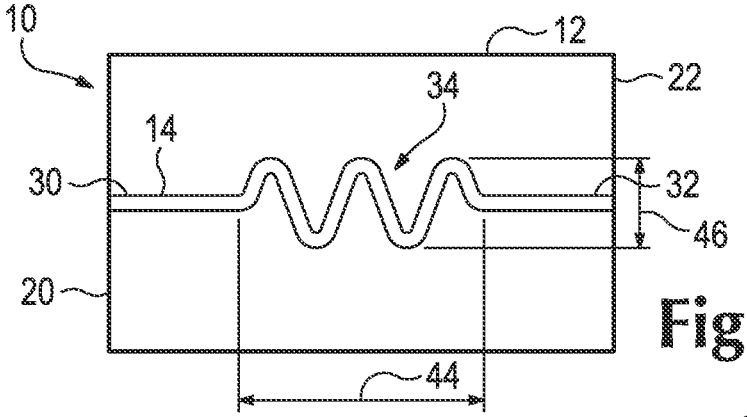
FIG. 3 is a schematic plan view of the knitted component of FIG. 1, wherein the stretch limiter element is shown in a second slack position.

More specifically, the slack position of the stretch limiter element 34 of FIG. 1 can be considered a first slack position. Stretch limiter element 34 can also be adjusted to a second slack position in some embodiments as shown in FIG. 3. This adjustment from the first slack position of FIG. 1 to the second slack position of FIG. 3 is represented by a change in length of stretch limiter element 34 from a first length 40 to a second length 44 and by a change in height of stretch limiter element 34 from a first height 42 to a second height 46. However, it will be appreciated that this is merely a schematic representation of the adjustment of the stretch limiter element 34 and that adjustment could occur in different ways without departing from the scope of the present disclosure.

Figure 4:
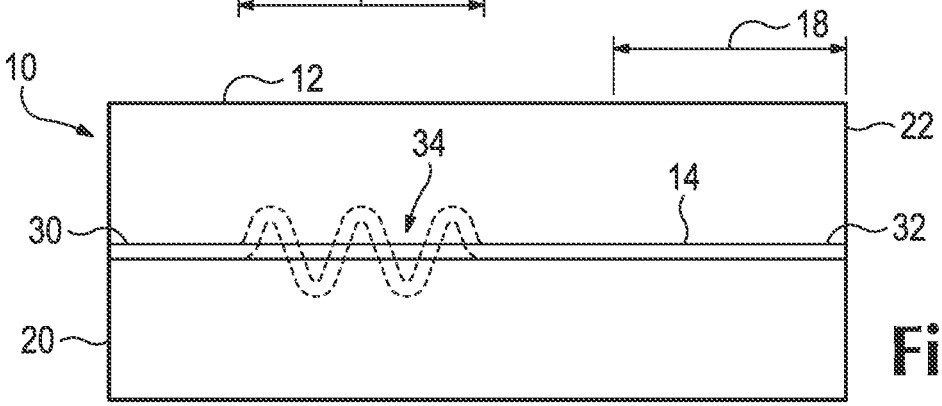
FIG. 4 is a schematic plan view of the knitted component of FIG. 3, wherein the stretch limiter element is shown in a taut position to prevent further stretching of the knit element.

As a result of the adjustment, knit element 12 can stretch from the neutral position of FIG. 3 to the stretched position of FIG. 4. At this position, tensile strand 14 can be taut and can prevent knit element 12 from stretching any further. Thus, knit element 12 can stretch across a second range of stretching motion 18 as indicated in FIG. 4.

In some embodiments, the second range of stretching motion 18 of FIG. 4 is less than the first range of stretching motion 16 of FIG. 2. Stated differently, tensile strand 14 can allow knitted component 10 to stretch over a larger range when stretch limiter element 34 is in the first slack position of FIG. 1 as compared to when stretch limiter element 34 is in the second slack position of FIG. 3.

Figure 5:
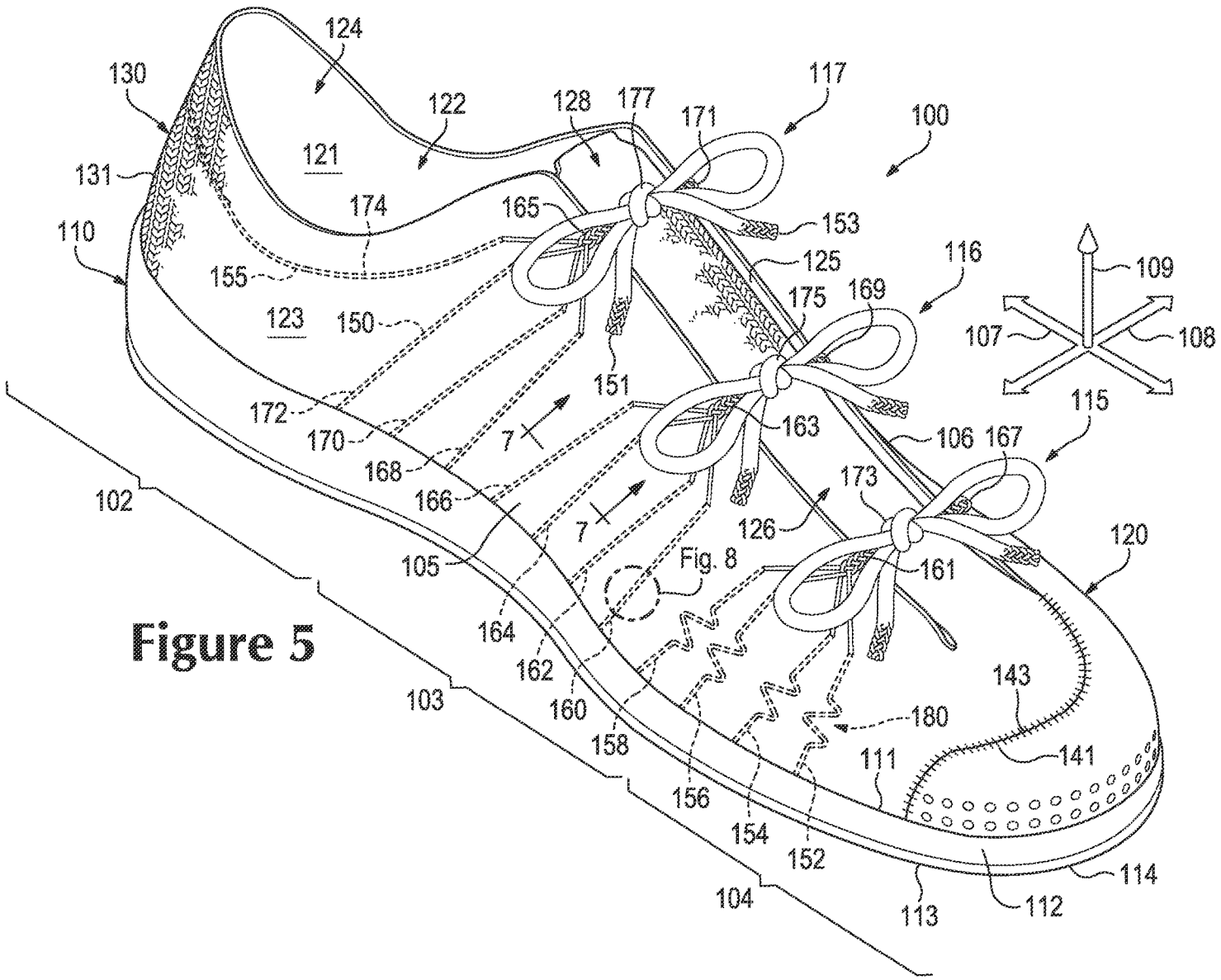
FIG. 5 is an isometric view of an article of footwear with a knitted component having stretch limiter elements according to exemplary embodiments of the present disclosure.

These and other concepts of the present disclosure will now be discussed in greater detail according to additional embodiments. For example, FIG. 5 shows an article of footwear 100 that can incorporate at least some of these features. However, it will be appreciated that these features can be incorporated in other objects without departing from the scope of the present disclosure.

General Discussion of Article of Footwear

Article of footwear 100 is illustrated according to exemplary embodiments in FIG. 5. Footwear 100 can generally include a sole structure 110 and an upper 120.

For reference purposes, footwear 100 may be divided into three general regions: a heel region 102, a midfoot region 103, and a forefoot region 104. Heel region 102 can generally include portions of footwear 100 corresponding with rear portions of the wearer's foot, including the heel and calcaneus bone. Midfoot region 103 can generally include portions of footwear 100 corresponding with middle portions of the wearer's foot, including an arch area. Forefoot region 104 can generally include portions of footwear 100 corresponding with forward portions of the wearer's foot, including the toes and joints connecting the metatarsals with the phalanges.

Footwear 100 can also include a medial side 105 and a lateral side 106. Medial side 105 and lateral side 106 can extend through forefoot region heel region 102, midfoot region 103, and forefoot region 104 in some embodiments. Medial side 105 and lateral side 106 can correspond with opposite sides of footwear 100. More particularly, lateral side 106 can correspond with an outside area of the wearer's foot (i.e. the surface that faces away from the other foot), and medial side 105 can correspond with an inside area of the wearer's foot (i.e., the surface that faces toward the other foot). Heel region 102, midfoot region 103, forefoot region 104, medial side 105, and lateral side 106 are not intended to demarcate precise areas of footwear 100. Rather, heel region 102, midfoot region 103, forefoot region 104, medial side 105, and lateral side 106 are intended to represent general areas of footwear 100 to aid in the following discussion.

Footwear 100 can also extend along various axes. For example, as shown in FIG. 5, footwear 100 can extend along a longitudinal axis 107, a transverse axis 108, and a vertical axis 109. Longitudinal axis 107 can extend generally between heel region 102 and forefoot region 104. Transverse axis 108 can extend generally between medial side 105 and lateral side 106. Also, vertical axis 109 can extend substantially perpendicular to both longitudinal axis 107 and transverse axis 108. It will be appreciated that longitudinal axis 107, transverse axis 108, and vertical axis 109 are merely included for reference purposes and to aid in the following discussion.

Embodiments of sole structure 110 will now be discussed. Sole structure 110 can be attached to upper 120 and can extend between the foot and the ground when footwear 100 is worn. In some embodiments, sole structure 110 can include a midsole 112 and an outsole 114. Midsole 112 can include a resiliently compressible material, fluid-filled bladders, and the like. As such, midsole 112 can cushion the wearer's foot and attenuate impact and other forces when running, jumping, and the like. Midsole 112 can include an upper surface 111 that is attached to upper 120. Outsole 114 can be secured to the midsole 112 and can include a wear resistant material, such as rubber and the like. Outsole 114 can also include tread and other traction-enhancing features. Outsole 114 can include a lower surface 113 that faces away from upper 120 and that defines a ground engaging surface of sole structure 110.

Embodiments of upper 120 will now be discussed with reference to FIGS. 5 and 6. Upper 120 is shown with sole structure 110 in FIG. 5. Also, upper 120 is shown without sole structure 110 and partially disassembled in FIG. 6.

As shown, upper 120 can define a void 122 that receives a foot of the wearer. Stated differently, upper 120 can define an interior surface 121 that defines void 122, and upper 120 can define an exterior surface 123 that faces in a direction opposite interior surface 121. When the wearer's foot is received within void 122, upper 120 can at least partially enclose and encapsulate the wearer's foot. Thus, upper 120 can extend about heel region 102, midfoot region 103, forefoot region 104, medial side 105, and lateral side 106 in some embodiments.

Upper 120 can include a main opening 124 that provides access into and out of void 122. Upper 120 can also include a throat 128. Throat 128 can extend from collar main opening 124 toward forefoot region 104. Throat 128 dimensions can be varied to change the width of footwear 100 between medial side 105 and lateral side 106. Thus, throat 128 can affect fit and comfort of article of footwear 100.

Figure 6:
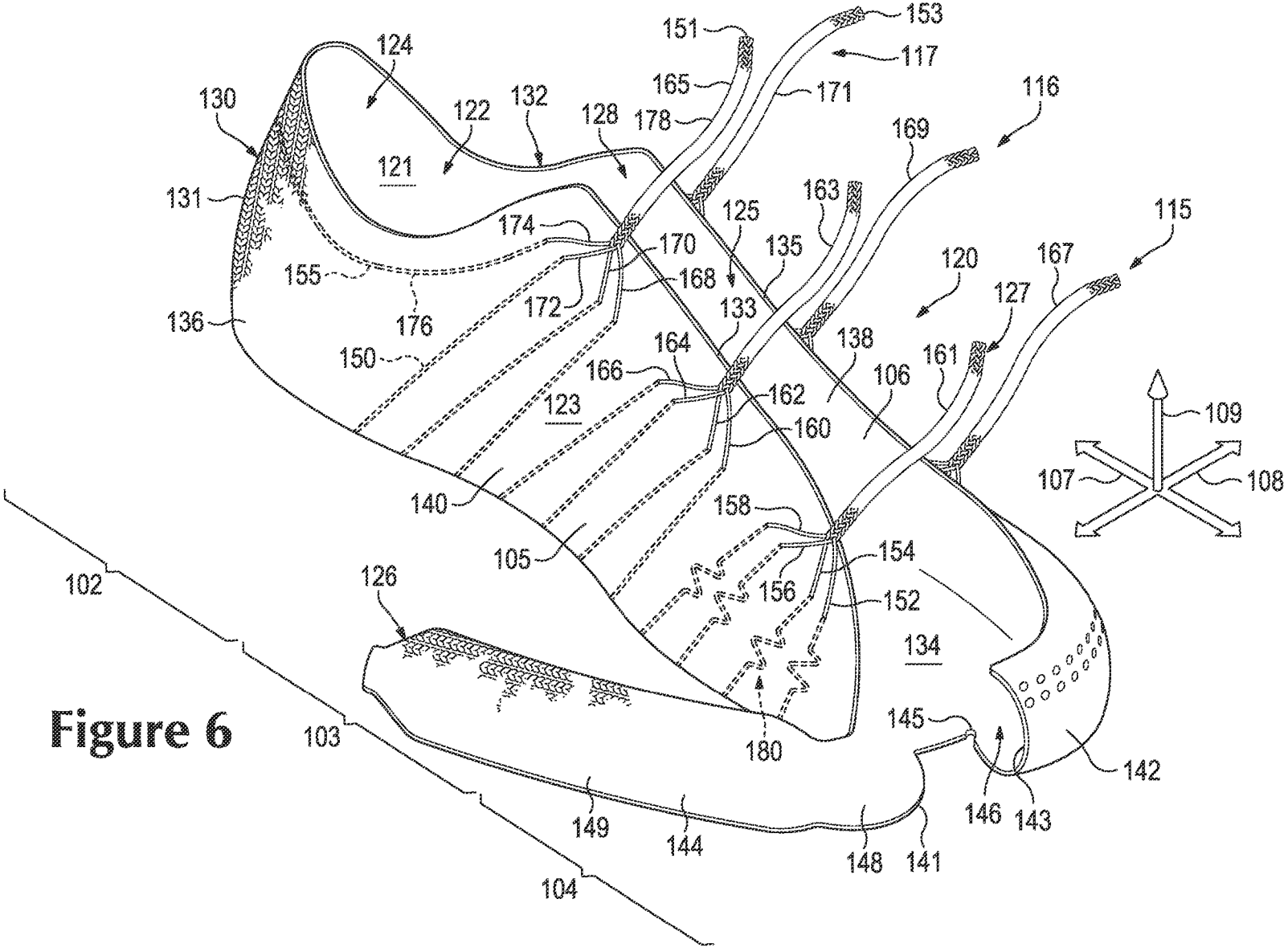
FIG. 6 is an isometric view of the knitted component of the article of footwear of FIG. 5.

In some embodiments, such as the embodiment of FIGS. 5 and 6, throat 128 can be an "open" throat 128, in which upper 120 includes a throat opening 125 that extends from main opening 124 toward forefoot region 104 and that is defined between medial side 105 and lateral side 106. In other embodiments, throat 128 can be a "closed" throat 128, in which upper 120 is substantially continuous and uninterrupted between medial side 105 and lateral side 106.

Additionally, throat 128 can include a tongue 126 that is disposed within throat opening 125. For example, in some embodiments, tongue 126 can be attached at its forward end to forefoot region 104, and tongue 126 can be detached from medial side 105 and lateral side 106. Accordingly, tongue 126 can substantially fill throat opening 125.

Many conventional footwear uppers are formed from multiple material elements (e.g., textiles, polymer foam, polymer sheets, leather, synthetic leather) that are joined through stitching or bonding, for example. In contrast, at least a portion of upper 120 is formed and defined by a knitted component 130. Knitted component 130 can be formed of unitary knit construction. Knitted component 130 is shown in plan view in FIGS. 8 and 9 according to some embodiments of the present disclosure. In some embodiments, knitted component 130 and/or other components of footwear 100 can include one or more features disclosed in commonly-owned U.S. patent application Ser. No. 14/026,589 to Podhajny, entitled "Article of Footwear Incorporating a Knitted Component with Integrally Knit Contoured Portion," filed on Sep. 13, 2013, the disclosure of which is incorporated by reference in its entirety.

Knitted component 130 can define at least a portion of the void 122 within upper 120 in some embodiments. Also, in some embodiments, knitted component 130 can define at least a portion of exterior surface 123. Furthermore, in some embodiments, knitted component 130 can define at least a portion of interior surface 121 of the upper 120. Additionally, in some embodiments, knitted component 130 can define a substantial portion of heel region 102, midfoot region 103, forefoot region 104, medial side 105, and lateral side 106 of upper 120. Thus, knitted component 130 can encompass the wearer's foot in some embodiments. Also, in some embodiments, knitted component 130 can compress the wearer's foot to secure to the wearer's foot.

Thus, upper 120 can be constructed with a relatively low number of material elements. This can decrease waste while also increasing the manufacturing efficiency and recyclability of upper 120. Additionally, knitted component 130 of upper 120 can incorporate a smaller number of seams or other discontinuities. This can further increase manufacturing efficiency of footwear 100. Moreover, interior surface 121 of upper 120 can be substantially smooth and uniform to enhance the overall comfort of footwear 100.

Knitted component 130 can be of "unitary knit construction." As defined herein and as used in the claims, the term "unitary knit construction" means that the knitted component 130 is formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of the knitted component 130. With this arrangement, a one-piece element of unitary knit construction is provided.

Although portions of knitted component 130 may be joined to each other following the knitting process, knitted component 130 remains formed of unitary knit construction because it is formed as a one-piece knit element. Moreover, knitted component 130 remains formed of unitary knit construction when other elements (e.g., an inlaid strand, a closure element, logos, trademarks, placards with care instructions and material information, and other structural elements) are added following the knitting process.

Features of knitted component 130 will now be discussed in greater detail according to various embodiments. Knitted component 130 can generally include a knit element 131. Knitted component 130 can also generally include at least tensile strand 150.

Figure 8:
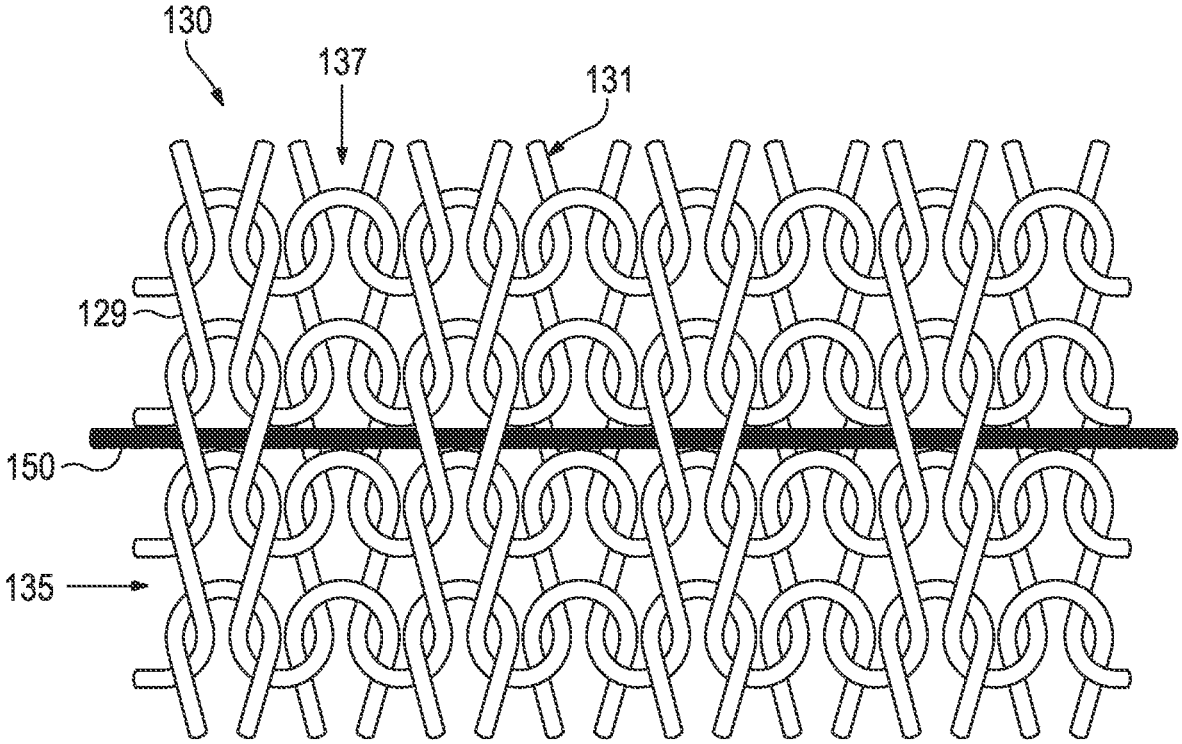
FIG. 8 is a detail view of the knitted component of FIG. 5.

In some embodiments, as shown in FIG. 8, knit element 131 of knitted component 130 may be formed from at least one yarn, cable, or other yarn 129 that is manipulated (e.g., with a knitting machine) to form a plurality of intermeshed loops that define a plurality of courses 135 and wales 137.

Moreover, as shown in FIG. 8, tensile strand 150 can be formed of unitary knit construction with knitted component 130. Strand 150 can provide support to knitted component 130. More specifically, in some embodiments, tension of strand 150 can allow knitted component 130 to resist deformation, stretching, or otherwise provide support for the wearer's foot during running, jumping, or other movements of the wearer's foot.

Figure 7:
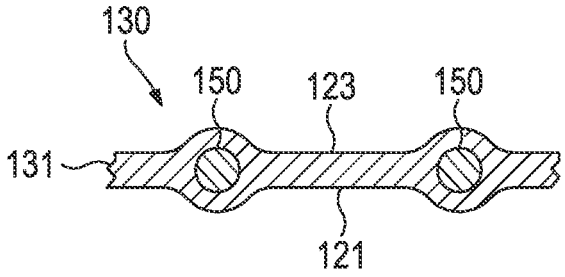
FIG. 7 is a section view of the knitted component taken along the line 7-7 of FIG. 5.

Tensile strand 150 can be attached to knit element 131 in any suitable fashion. For example, in some embodiments, at least a portion of strand 150 can be inlaid within one or more courses 135 and/or wales 137 of knit element 131 such that the strand 150 can be incorporated during the knitting processes on the knitting machine. More specifically, as shown in the embodiment of FIG. 8, tensile strand 150 can alternate between being located: (a) behind loops formed from yarn 129; and (b) in front of loops formed from yarn 129. In effect, tensile strand 150 weaves through the unitary knit construction of knit element 131. As a result, in some embodiments represented in FIG. 7, tensile strand 150 can be disposed within knit element 131 between exterior surface 123 and interior surface 121 of upper 120.

Yarn(s) that form knit element 131 can be of any suitable type. For example, yarn 129 of knit element 131 can be made from cotton, elastane, rayon, wool, nylon, polyester, or other material. Also, in some embodiments, yarn 129 can be elastic and resilient. As such, yarn 129 can be stretched in length from a first length, and yarn 129 can be biased to recover to its first length. Thus, such an elastic yarn 129 can allow knit element 131 to stretch elastically and resiliently under the influence of a force. When that force is reduced, knit element 131 can recover back its neutral position.

Furthermore, in some embodiments, yarn 129 can be at least partially formed from a thermoset polymer material that can melt when heated and that can return to a solid state when cooled. As such, yarn 129 can a fusible yarn and can be used to join two objects or elements together. In additional embodiments, knit element 131 can include a combination of fusible and non-fusible yarns. In some embodiments, for example, knitted component 130 and upper 120 can be constructed according to the teachings of U.S. Patent Publication No. 2012/0233882, which published on Sep. 20, 2012, and the disclosure of which is hereby incorporated by reference in its entirety.

Additionally, in some embodiments, a single yarn 129 can form each of the courses 135 and wales 137 of knit element 131. In other embodiments, knit element 131 can include a plurality of strands. For example, different strands can form different courses 135 and/or different wales 137. In additional embodiments, a plurality of strands can cooperate to define a common loop, a common course and/or a common wale.

Tensile strand 150 can also be of any suitable type of strand, yarn, cable, cord, filament (e.g., a monofilament), thread, rope, webbing, or chain, for example. In comparison with the yarns forming knit element 131, the thickness of tensile strand 150 may be greater. In some configurations, tensile strand 150 may have a significantly greater thickness than the yarns of knit element 131. Although the cross-sectional shape of tensile strand 150 may be round, triangular, square, rectangular, elliptical, or irregular shapes may also be utilized. Moreover, the materials forming tensile strand 150 may include any of the materials for the yarn within knit element 131, such as cotton, elastane, polyester, rayon, wool, and nylon. As noted above, tensile strand 150 may exhibit greater stretch-resistance than knit element 131. As such, suitable materials for tensile strand 150 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as tensile strand 150.

In some embodiments, knitted component 130 can share one or more features discussed above in relation to FIGS. 1-4. For example, knitted component 130 can include one or more features that cause knit element 131 to stretch in a predetermined and controlled manner in some embodiments. For example, knitted component 130 can include one or more features and structures that limit the range of stretching motion of knit element 131. Also, the range of stretching of knit element 131 can be adjustable and controllable in some embodiments. For example, knitted component 130 can have a first configuration in which a first range of stretching motion is allowed, and knitted component 130 can have a different, second configuration in which a larger, smaller range of stretching motion is allowed.

Configurations of Knit Element

Figure 9:
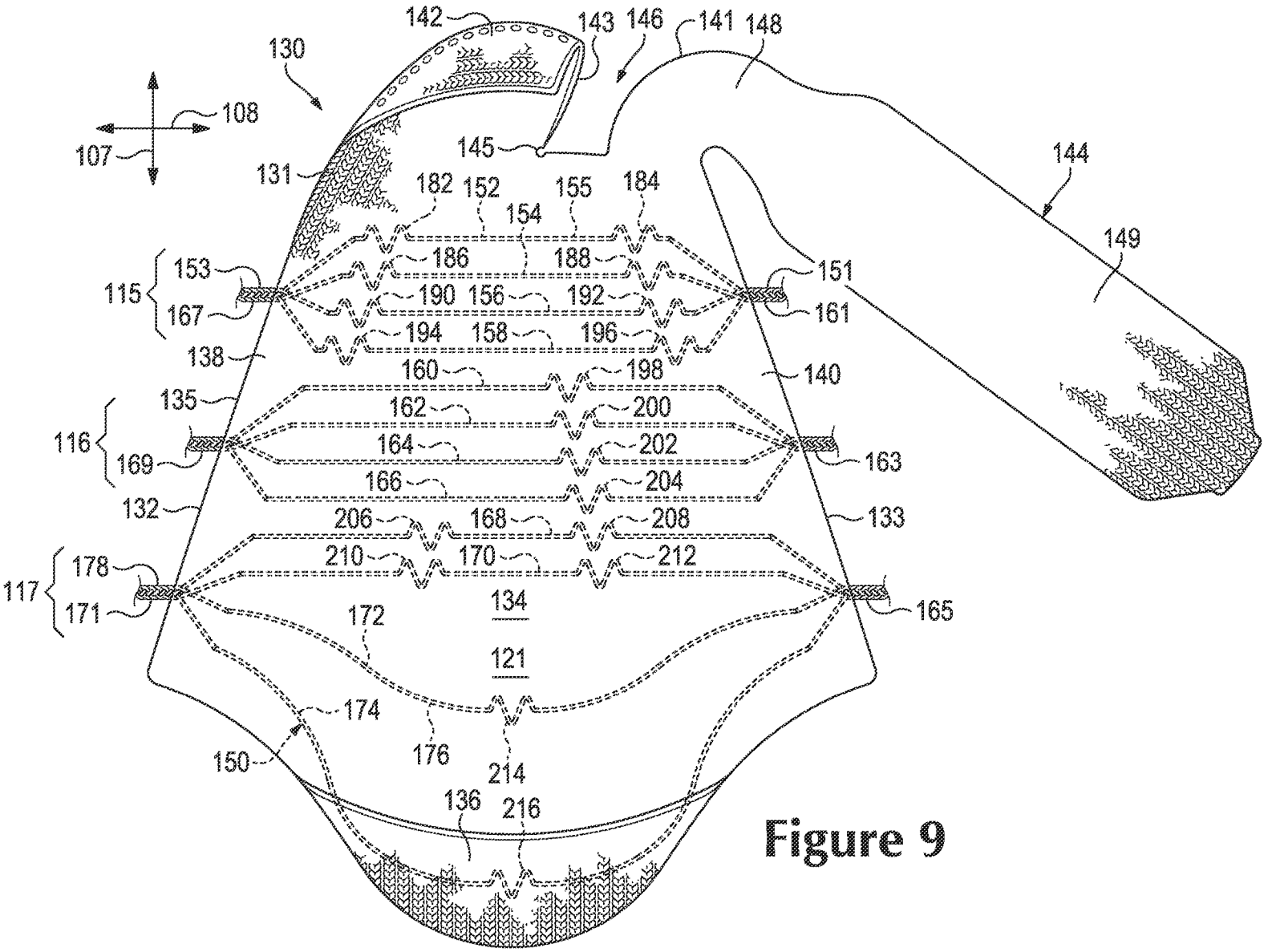
FIG. 9 is a top plan view of the knitted component of FIG. 5.
Figure 10:
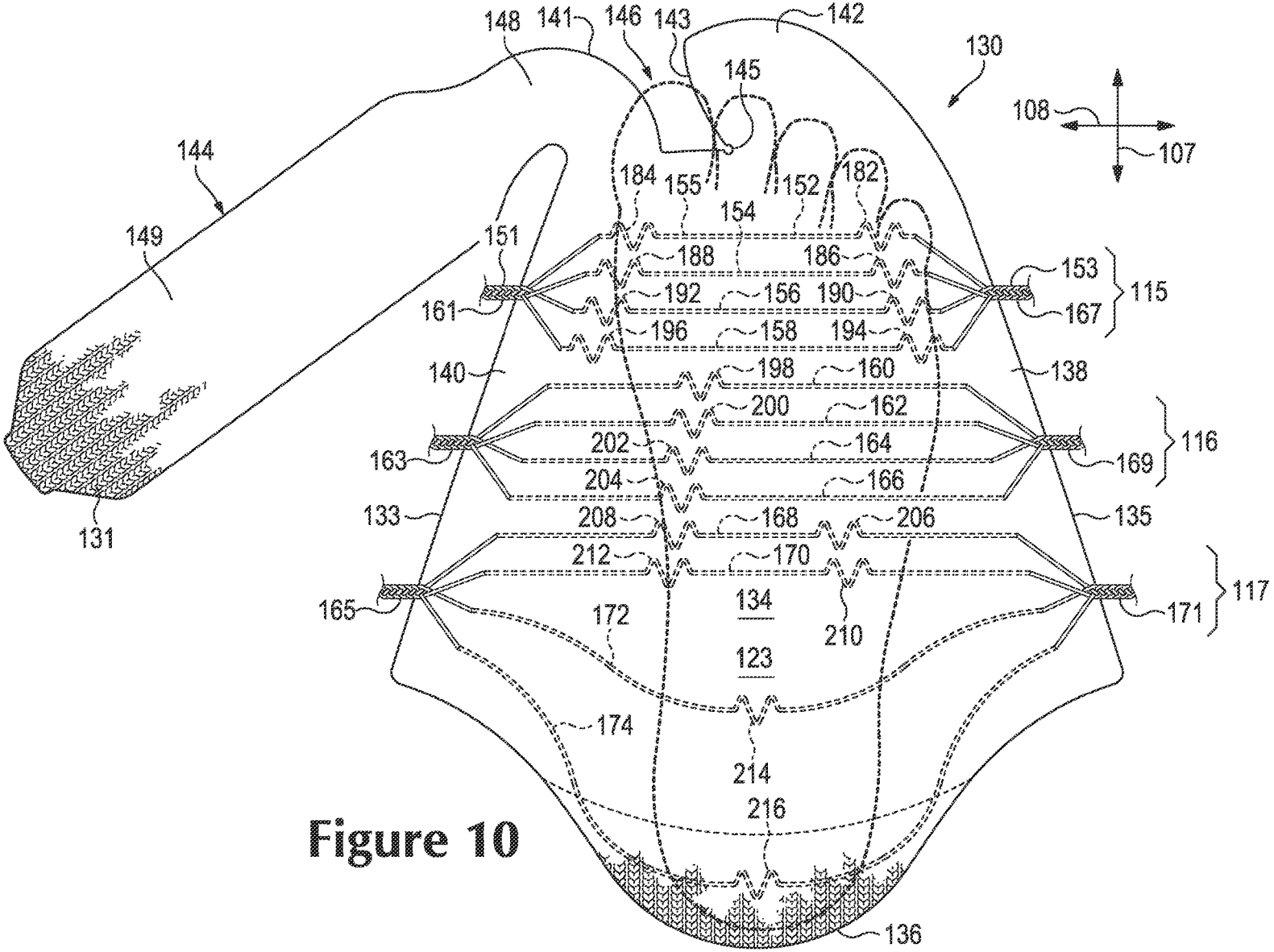
FIG. 10 is a bottom plan view of the knitted component of FIG. 5.

Referring now to FIGS. 6, 9 and 10, knit element 131 of knitted component 130 will be discussed in greater detail according to some embodiments. Knit element 131 can define a majority of knitted component 130 and upper 120 in some embodiments.

More specifically, knit element 131 can include a base portion 134 in some embodiments. Base portion 134 can also be referred to as a strobel portion or underfoot portion in some embodiments. Base portion 134 can be configured to be disposed adjacent sole structure 110. For instance, base portion 134 can lie over upper surface 111 of sole structure 110 and can attach directly or indirectly to upper surface 111. In additional embodiments, one or more parts of base portion 134 (e.g., a periphery of the base portion 134) can attach to sole structure 110 while other parts remain detached or decoupled. Also, base portion 134 can be configured to extend underneath the wearer's foot.

Knit element 131 can further include a heel portion 136. Heel portion 136 can be disposed on one end of the base portion 134. Heel portion 136 can also extend upwards from the base portion 134 along vertical axis 109 as shown in FIG. 6. Heel portion 136 can define heel region 102 of upper 120 and can be configured to cover over a heel and/or an ankle area of the wearer's foot.

Knit element 131 can additionally include a lateral portion 138 and a medial portion 140. Lateral portion 138 can be disposed forward relative to the heel portion 136, and can extend upwards from a lateral side of the base portion 134 as shown in FIG. 6. Lateral portion 138 can define lateral side 106 of upper 120 and can be configured to cover over and lie against a lateral area of the wearer's foot. Furthermore, medial portion 140 can be disposed on an opposite side of the base portion 134 relative to the lateral portion 138. Medial portion 140 can be disposed forward of heel portion 136 along longitudinal axis 107. Medial portion 140 can extend upwards along the vertical axis 109 from the base portion 134 as shown in FIG. 6. Medial portion 140 can define medial side 105 of upper and can be configured to cover over and lie against a medial area or instep of the wearer's foot.

Still further, knit element 131 can include a forefoot portion 142. Forefoot portion 142 can be disposed on an opposite end of the base portion 134 relative to the heel portion 136. Forefoot portion 142 can also be disposed forward of the lateral and medial portions 130, 132. Also, in some embodiments, forefoot portion 142 can be integrally connected to either lateral portion 138 or medial portion 140, and forefoot portion 142 can be detached and spaced from the other. In the embodiment shown, for instance, forefoot portion 142 is integrally connected to lateral portion 138 and is spaced from medial portion 140. Accordingly, when upper 120 is in a disassembled state as shown in FIGS. 6, 9 and 10, a gap 146 can be defined between forefoot portion 142 and medial portion 140.

Moreover, knit element 131 can include a tongue portion 144. As shown, tongue portion 144 can include a curved region 148 and a longitudinal region 149. As shown in FIGS. 6, 9, and 10, tongue portion 144 can extend generally forward from base portion 134. Curved region 148 can also curve such that longitudinal region 149 extends generally rearwardly and at an angle relative to medial portion 140 as shown in FIGS. 6, 9, and 10.

Also, when upper 120 is assembled as shown in FIG. 5, curved region 148 can wrap upwards to at least partially fill gap 146, and longitudinal region 149 of the tongue portion 144 can be disposed within throat 128 of upper 120 to cover over the wearer's foot between lateral portion 138 and medial portion 140.

Knit element 131 can additionally include at least two edge portions 141, 143 that are configured to be joined together when assembling upper 120. Edge portions 141, 143 can be defined in any suitable location along a perimeter edge 132 of knit element 131 or in any other suitable area of knit element 131. For example, as shown in FIGS. 5 and 6, first edge portion 141 can extend along curved region 148 of tongue portion 144 and can also extend partially through base portion 134 along transverse axis 108, adjacent forefoot portion 142. Second edge portion 143 can curve along forefoot portion 142, generally along transverse axis 108 and can extend downward along vertical axis 109 within forefoot portion 142 so as to partially define gap 146. First edge 141 and second edge 143 can also meet at a notch 145 defined within base portion 134 as shown in FIG. 6. As shown in FIG. 5, edge portion 141 can be joined to edge portion 143 using stitching, adhesives, fasteners, or other attachment devices.

Configurations of Tensile Strands

Referring now to FIGS. 6, 9, and 10, tensile strands 150 of knitted component 130 will be discussed in greater detail. It will be appreciated that knitted component 130 can include any number of tensile strands 150, and tensile strands 150 can extend across any portion of knit element 131.

Tensile strands 150 can each include a respective first end 151, a second end 153, and a middle section 155. In the embodiment illustrated in FIGS. 9 and 10, first ends 151 of tensile strands 150 are disposed proximate to medial portion 140 of knit element 131, and second ends 153 of tensile strands 150 are disposed proximate lateral portion 138 of knit element 131. Moreover, middle sections 155 of tensile strands 150 can extend continuously between medial portion 140 and lateral portion 138 of knit element 131.

Also, in some embodiments, first ends 151 can extend from medial potion 140 and can be exposed from medial portion 140. First ends 151 can also extend beyond a perimeter edge 133 of medial portion 140 in some embodiments. Likewise, second ends 153 can extend from lateral portion 138 and can be exposed from lateral portion 138. Second ends 153 can extend beyond a perimeter edge 135 of lateral portion 138 in some embodiments. In contrast, middle sections 155 can be inlaid within knit element 131 in some embodiments. Therefore, first ends 151 and second ends 153 can be referred to as exposed sections 176 of tensile strands 150, and middle sections 155 can be referred to as inlaid sections 178 of tensile strands 150.

In other embodiments, first ends 151 and/or second ends 153 can be enclosed within knit element 131. For example, first ends 151 and/or second ends 153 can be inlaid within knit element 131. Also, in some embodiments, first ends 151 and/or second ends 153 can be fixed to knit element 131 via adhesives, fasteners, knotting, or other attachment device.

In the embodiment of FIGS. 5, 6, 9, and 10, the plurality of tensile strands 150 can comprise a first tensile strand 152, a second tensile strand 154, a third tensile strand 156, a fourth tensile strand 158, a fifth tensile strand 160, a sixth tensile strand 162, a seventh tensile strand 164, an eighth tensile strand 166, a ninth tensile strand 168, a tenth tensile strand 170, an eleventh tensile strand 172, and a twelfth tensile strand 174. Each of these tensile strands 150 can generally extend between lateral portion 138 and medial portion 150; however, these tensile strands 150 can be spaced apart along longitudinal axis 107.

Additionally, first tensile strand 152, second tensile strand 154, third tensile strand 156, and fourth tensile strand 158 can be generally disposed within forefoot region 104 and can be collectively referred to as forefoot tensile strands 115 of knitted component 130. Moreover, fifth tensile strand 160, sixth tensile strand 162, seventh tensile strand 164, and eighth tensile strand 166 can be generally disposed within midfoot region 103 and can be collectively referred to as midfoot tensile strands 116 of knitted component. Additionally, ninth tensile strand 168, tenth tensile strand 170, eleventh tensile strand 172, and twelfth tensile strand 174 can be generally disposed within heel region 102 and can be collectively referred to as heel tensile strands 117 of knitted component 130.

Moreover, as shown in FIGS. 9 and 10, first tensile strand 152, second tensile strand 154, third tensile strand 156, fourth tensile strand 158, fifth tensile strand 160, sixth tensile strand 162, seventh tensile strand 164, eighth tensile strand 166, ninth tensile strand 168, tenth tensile strand 170, and eleventh tensile strand 172 can extend continuously from lateral portion 138, across base portion 134, to medial portion 140. Thus, as shown in FIGS. 5 and 6 these tensile strands 150 can extend around and underneath the wearer's foot. In contrast, as shown in FIGS. 9 and 10, twelfth tensile strand 174 can extend continuously from lateral portion 138, across heel portion 136, to medial portion 140. Thus, twelfth tensile strand 174 can extend behind the wearer's foot and/or ankle.

In some embodiments, one or more tensile strands 150 can be secured together. For example, in some embodiments, one or more first ends 151 of tensile strands 150 can be secured together in a bundle 127. Likewise, in some embodiments, one or more second ends 153 can be secured in a bundle 127. For example, as shown in the embodiment of FIGS. 6, 9, and 10, plural first ends 151 and/or plural second ends 153 can be twisted, braided, or otherwise gathered and secured together.

Specifically, in some embodiments, first ends 151 of first tensile strand 152, second tensile strand 154, third tensile strand 156, and fourth tensile strand 158 may be secured together in a first medial braid 161. Second ends 153 of first tensile strand 152, second tensile strand 154, third tensile strand 156, and fourth tensile strand 158 may be secured together in a first lateral braid 167. Moreover, first ends 151 of fifth tensile strand 160, sixth tensile strand 162, seventh tensile strand 164, and eighth tensile strand 166 may be secured together in a second medial braid 163. Second ends 153 of fifth tensile strand 160, sixth tensile strand 162, seventh tensile strand 164, and eighth tensile strand 166 may be secured together in a second lateral braid 169. Also, first ends 151 of ninth tensile strand 168, tenth tensile strand 170, eleventh tensile strand 172, and twelfth tensile strand 174 can be secured together in a third medial braid 165. Second ends 153 of ninth tensile strand 168, tenth tensile strand 170, eleventh tensile strand 172, and twelfth tensile strand 174 can be secured together in a third lateral braid 171.

Additionally, in some embodiments, two or more braids can be secured together. For example, as shown in FIG. 5, first medial braid 161 and first lateral braid 167 can be secured together in a first tie 173 in some embodiments. Likewise, second medial braid 163 and second lateral braid 169 can be secured together in a second tie 175. Moreover, third medial braid 165 and third lateral braid 171 can be secured together in a third tie 177 in some embodiments. It will be appreciated that first tie 173, second tie 175, and third tie 177 can allow tensile strands 150 to substantially encircle the wearer's foot about the longitudinal axis 107 to further secure footwear 100 to the wearer's foot. Also it will be appreciated that first tie 173, second tie 175, and/or third tie 177 can be untied in order to loosen footwear 100 for putting on or removing the wearer's foot from footwear 100.

It will be appreciated that first ends 151 and second ends 153 of tensile strands 150 can be secured together in ways other than as illustrated in FIGS. 5 and 6. Also, in some embodiments, additional objects, such as a shoelace, a clamp, or other securement devices can be included for securing ends of tensile strands 150 together. For example, in some embodiments, a shoelace can secure the tensile strands 150 of the medial side 105 to the tensile strands 150 of the lateral side 106. More specifically, in some embodiments, first ends 151 can form one or more loops that receive the shoelace on medial side 105 of footwear 100, and second ends 153 can form one or more additional loops that receive the shoelace on lateral side 106 of footwear 100. Then, shoelace can be tied in a knot and/or bow to secure first ends 151 to second ends 153.

Configurations of Stretch Limiter Elements

As stated above, knit element 131 can be stretchable. To control this stretching, one or more of tensile strands 150 can include at least one stretch limiter element 180 as shown in FIGS. 5, 6, 9, and 10. Like the embodiments of FIGS. 1-4, stretch limiter elements 180 can limit the range of stretching motion of knit element 131. Accordingly, knitted component 130 can stretch in a predetermined, controlled manner.

Figure 11:
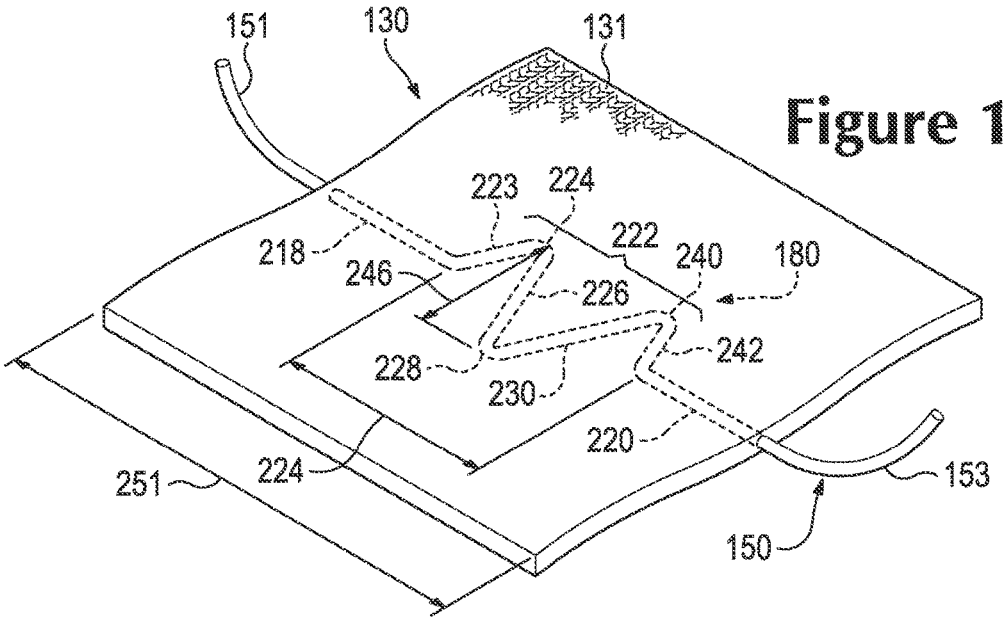
FIG. 11 is a perspective view of a stretch limiter element of the knitted component of FIG. 5, wherein the stretch limiter element is shown in a first slack position.

FIG. 11 illustrates one such stretch limiter element 180 in detail. Stretch limiter element 180 is shown in a slack position. Knit element 131 is shown in a neutral or unstretched position in FIG. 11 as well. In the unstretched position, knit element 131 can have a first length 251. As knit element 131 stretches from the neutral position of FIG. 11 to the stretched position of FIG. 12, stretch limiter element 180 can move from the slack position to the taut position. Upon reaching the taut position, tension of stretch limiter element 180 can prevent further stretching of knit element 131. Thus, knit element 131 can stretch to a second length 253.

More specifically, in the embodiment of FIG. 11, stretch limiter element 180 can be subdivided into a first section 218, a second section 220, and an intermediate section 222 that is disposed between first linear section 218 and second linear section 220. First linear section 218 and second linear section 220 can be substantially linear in some embodiments. In contrast, intermediate section 222 can extend along a nonlinear path between first section 218 and second section 220 as represented in FIG. 11. For example, in some embodiments, intermediate section 222 can extend along a serpentine path when in the slack position. For example, in the slack position of FIG. 11, intermediate section 222 can define a first transverse section 223, a first turn 224, a second transverse section 226, a second turn 228, a third transverse section 230, a third turn 240, and a fourth transverse section 242.

In some embodiments, stretch limiter element 180 can be inlaid within knit element 131. For example, in some embodiments, first section 218 and second section 220 can extend along a common course of knit element 131, whereas intermediate section 22 can extend through different courses and wales of knit element 131.

Furthermore, in some embodiments, areas of stretch limiter element 180 and/or other areas of tensile strand 150 can be fixed to knit element 131. For example, in some embodiments, first turn 224, second turn 228, and third turn 240 can be fixed to knit element 130. In additional embodiments, first end 151 and second end 153 can be fixed to knit element 130. Tensile strand 150 can be fixed to knit element 131 via adhesives, via a fastener, or other components. In other embodiments, areas of tensile strand 150 can be fused to knit element 131. Other areas of tensile strand 150 can be moveable or slideable relative to knit element 131.

Figure 12:
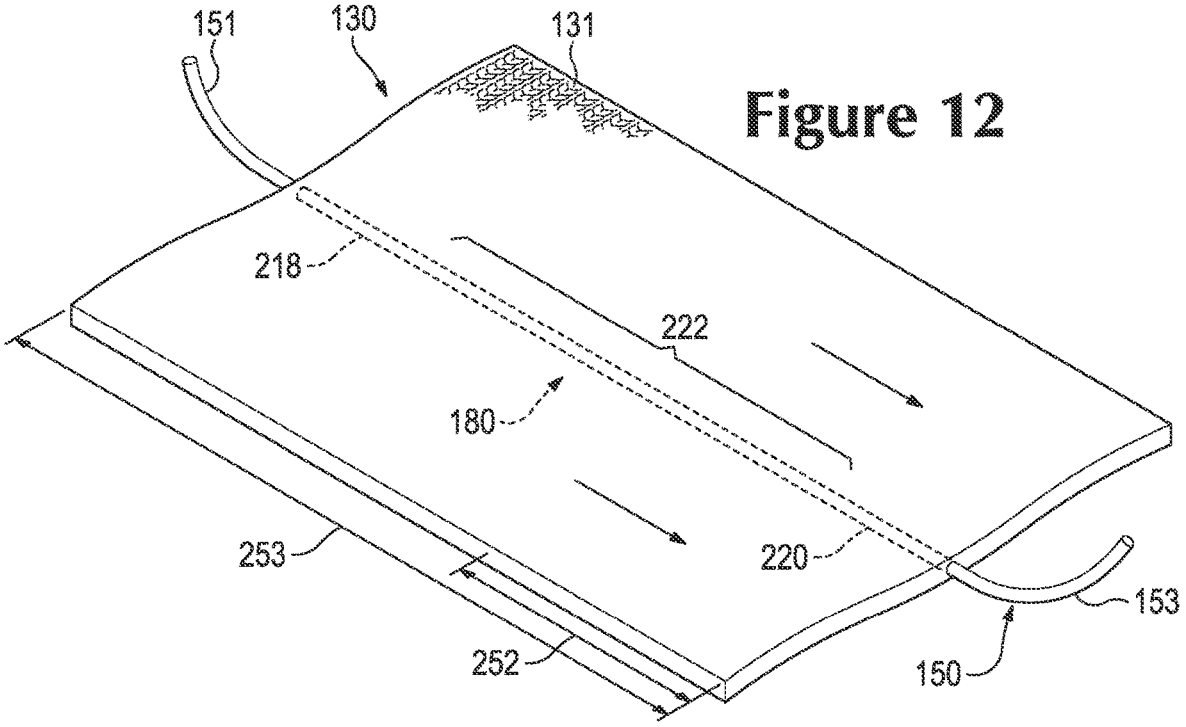
FIG. 12 is a perspective view of the stretch limiter element of FIG. 11, wherein the stretch limiter element is shown in a taut position to prevent further stretching of the knit element.

As knit element 131 stretches from the neutral position of FIG. 11 to the stretched position of FIG. 12, intermediate section 222 can straighten out and become substantially linear. Eventually, intermediate section 222 can move to the taut position represented in FIG. 12. In some embodiments, in the taut position, first transverse section 223, first turn 224, second transverse section 226, second turn 228, third transverse section 230, third turn 240, and fourth transverse section 242 can substantially align with first linear section 218 and second linear section 220. Upon reaching the taut position, stretch limiter element 180 can increase in tension and prevent further stretching of knit element 131.

In some embodiments, this type of controlled stretching can be exhibited in a relatively small area of knitted component 130. For example, areas of knit element 131 immediately adjacent stretch limiter element 180 can stretch in the manner represented in FIGS. 11 and 12.

In other embodiments, this type of controlled stretching can be exhibited across a larger area of knitted component 130. For example, in some embodiments, knitted component 130 can exhibit this type of stretching between perimeter edge 133 of medial side 140 of upper 120 and perimeter edge 135 of lateral side 138 of upper 120.

Figure 15:
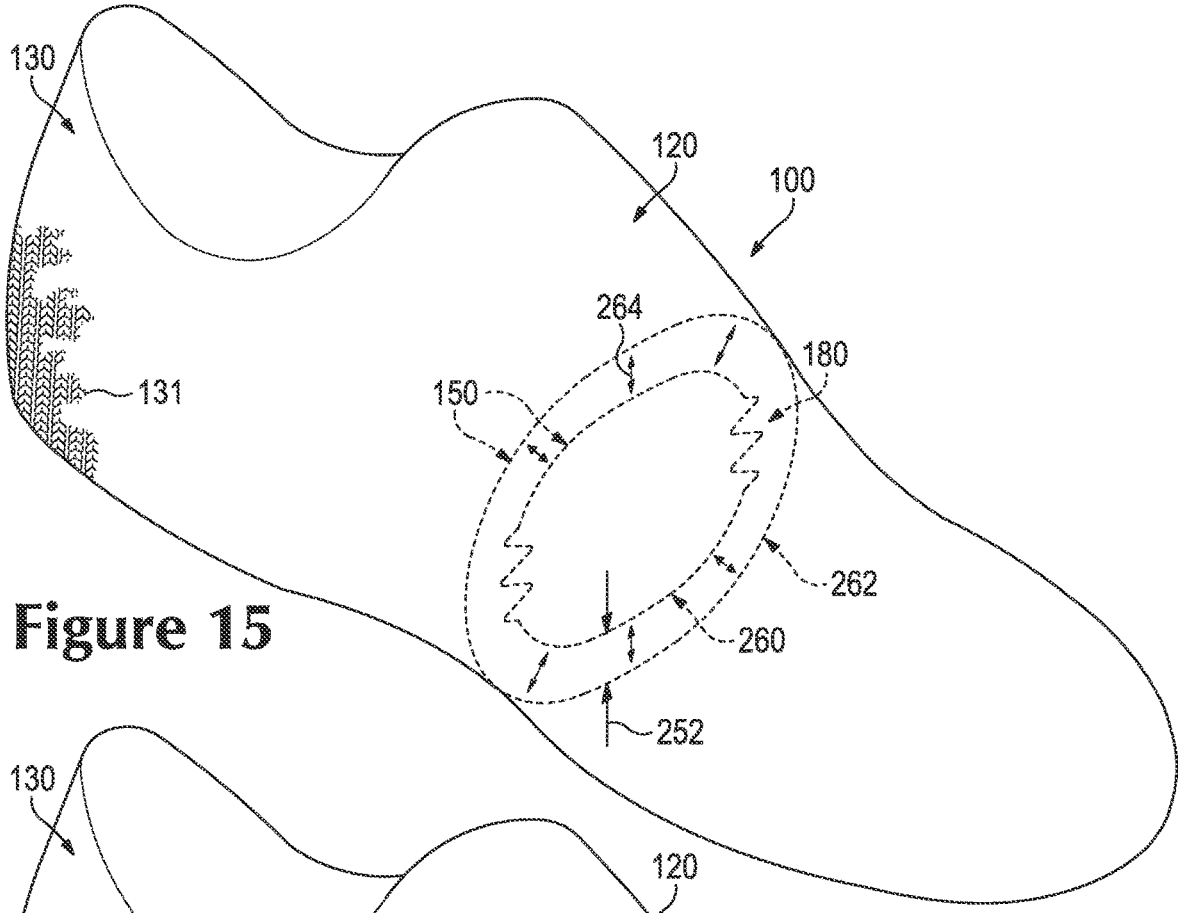
FIG. 15 is a schematic isometric view of the knitted component of FIG. 5 showing a stretch limiter element that allows stretching of the midfoot region within a first range.

FIG. 15 schematically illustrates this type of stretching according to some embodiments. As shown, knit element 131 is assembled and forms upper 120. Also, tensile strand 150 extends about the midfoot region of knit element 131. For example, tensile strand 150 shown in FIG. 15 could represent fifth tensile strand 160, sixth tensile strand 162, seventh tensile strand 164, or eighth tensile strand 166 of FIG. 5. (The second tie 175 is not shown for purposes of clarity.) Tensile strand 150 is also shown in the slack position as indicated at 260 and at the taut position as indicated at 262.

In some embodiments, knitted component 130 can stretch at the midfoot region, for example, due to flexure of the wearer's foot, due to impact with the ground, or for other reasons. As a result, knit element 131 can expand radially, and tensile strand 150 can move from the slack position 260 to the taut position 262 as indicated by arrows 264. Upon reaching the taut position 262, tension in tensile strand 150 can prevent further stretching of knit element 131.

Additionally, in some embodiments, knit element 131 can be biased toward the neutral position and/or stretch limiter element 180 can be biased toward the slack position. In some embodiments, this biasing can be caused by the normal resiliency of the knit element 131. In additionally embodiments, this biasing can be caused by elasticity of the strands used to form knit element 131. Thus, as the stretching force is reduced, knit element 131 can recover toward the neutral position and stretch limiter element 180 can recover toward the slack position.

Accordingly, in some embodiments, knit element 131 can be in the neutral position and can compress against the wearer's foot to secure footwear 100 to the wearer's foot. Knit element 131 can also stretch, for example, in response to flexure of the wearer's foot, due to impact with the ground, or for another reason. However, stretch limiter element 180 can prevent knit element 131 from stretching too far. For example, stretch limiter element 180 can limit stretching of knit element 131 such that knit element 131 remains secured to the wearer's foot. Then, when the stretching force is reduced, knit element 131 can recover back to the neutral position, and stretch limiter element 180 can recover back to the slack position.

It will be appreciated that knitted component 130 can include any number of stretch limiter elements 180, and stretch limiter elements 180 can be disposed in any suitable location on knit element 131. Thus, stretch limiter elements 180 of the forefoot tensile strands 115 can affect stretching within forefoot region 104. Likewise, stretch limiter elements 180 of the midfoot tensile strands 116 can affect stretching in midfoot region 103. Also, stretch limiter elements 180 of the heel tensile strands 117 can affect stretching in heel region 102.

For example, in the embodiment of FIGS. 9 and 10, first tensile strand 152 can include a first limiter element 182 and a second limiter element 184. Second tensile strand 154 can include a third limiter element 186 and a fourth limiter element 188. Third tensile strand 156 can include a fifth limiter element 190 and a sixth limiter element 192. Furthermore, fourth tensile strand 158 can include a seventh limiter element 194 and an eighth limiter element 196. In some embodiments, first limiter element 182, third limiter element 186, fifth limiter element 190, and seventh limiter element 194 can be disposed within lateral portion 138 of knit element 131. In contrast, second limiter element 184, fourth limiter element 188, sixth limiter element 192, and eighth limiter element 196 can be disposed within medial portion 140 of knitted component 130.

Additionally, fifth tensile strand 160 can include a ninth limiter element 198, sixth tensile strand 162 can include a tenth limiter element 200, seventh tensile strand 164 can include an eleventh limiter element 202, and eighth tensile strand 166 can include a twelfth limiter element 204. Also, ninth limiter element 198, tenth limiter element 200, eleventh limiter element 202, and twelfth limiter element 204 can be disposed within base portion 134 and proximate medial portion 140. Thus, as shown in FIG. 10, ninth limiter element 198, tenth limiter element 200, eleventh limiter element 202, and twelfth limiter element 204 can be disposed underneath an arch region of the wearer's foot.

Furthermore, ninth tensile strand 168 can include a thirteenth limiter element 206 and a fourteenth limiter element 208. Tenth tensile strand 170 can include a fifteenth limiter element 210 and a sixteenth limiter element 212. Furthermore, eleventh tensile strand 172 can include a seventeenth limiter element 214, and twelfth tensile strand 174 can include an eighteenth limiter element 216. Thirteenth limiter element 206 and fifteenth limiter element 210 can be disposed within base portion 134 and proximate lateral portion 138. Fourteenth limiter 208 and sixteenth limiter element 212 can be disposed within base portion 134 and proximate medial portion 140. Also, in some embodiments, seventeenth limiter element 214 can be disposed in within base portion 134, and eighteenth limiter element 216 can be disposed within heel portion 136.

Adjustment of Range of Stretching

In some embodiments, one or more stretch limiter elements 180 can be adjustable for changing the allowable range of stretching motion of knit element 131. In some embodiments, the wearer can adjust and move stretch limiter element 180 from the first slack position of FIG. 11 to the second slack position of FIG. 13 to change the available range of stretching knit element 131. In this embodiment, if stretch limiter element 180 is in the first slack position of FIG. 11, then knit element 131 can stretch from the first length 251 to the second length 253 as shown in FIG. 12. Stated differently, stretch limiter element 180 can allow stretching of knit element 131 within the range 252 (i.e., the difference between first length 251 and second length 253) as shown in FIG. 12. However, if the stretch limiter element 180 is in the second slack position of FIG. 13, stretch limiter element 180 can allow knit element 131 to stretch within a smaller range. For example, if stretch limiter element 180 is in the second slack position of FIG. 13, then knit element 131 can stretch from the first length 251 to a third length 255. Stated differently, stretch limiter element 180 can allow stretching of knit element 131 within the smaller range 254 (i.e., the difference between first length 251 and third length 255) as shown in FIG. 14.

Figure 16:
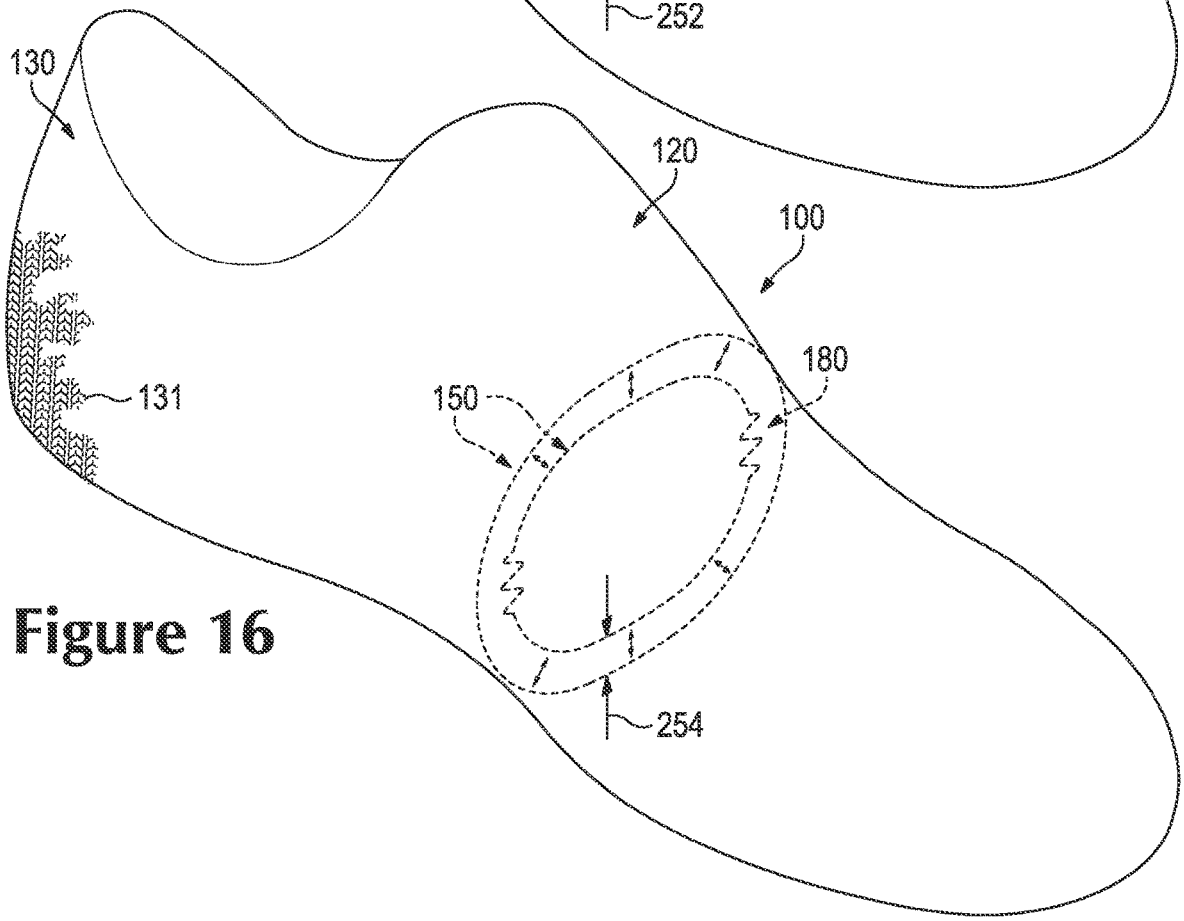
FIG. 16 is a schematic isometric view of the knitted component of FIG. 5 showing a stretch limiter element that allows stretching of the midfoot region within a second range.

This behavior is also illustrated schematically in FIGS. 15 and 16. In FIG. 15, tensile strand 150 is shown in the first slack position and the respective taut position. Thus, knit element 131 can stretch radially at the midfoot region within the range of stretching motion 252 as shown in FIG. 15. In contrast, in FIG. 16, tensile strand 150 is shown in both the second slack position and the respective taut position. Thus, knit element 131 can stretch radially within the smaller range of stretching motion 254 as shown in FIG. 16.

Figure 13:
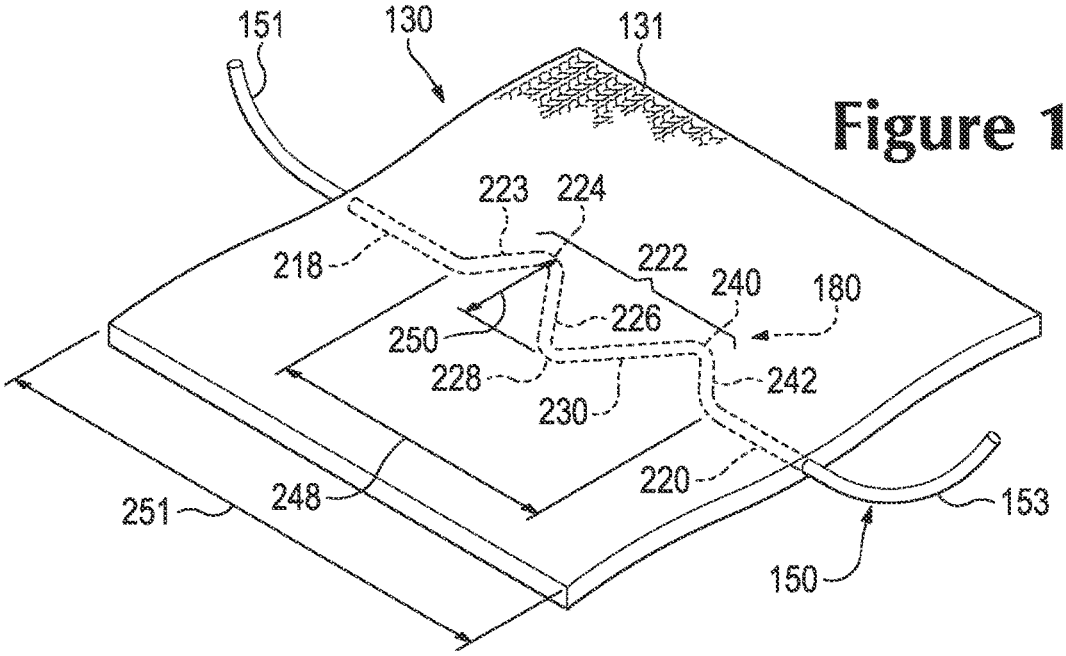
FIG. 13 is a perspective view of a stretch limiter element of the knitted component of FIG. 5, wherein the stretch limiter element is shown in a second slack position.
Figure 14:
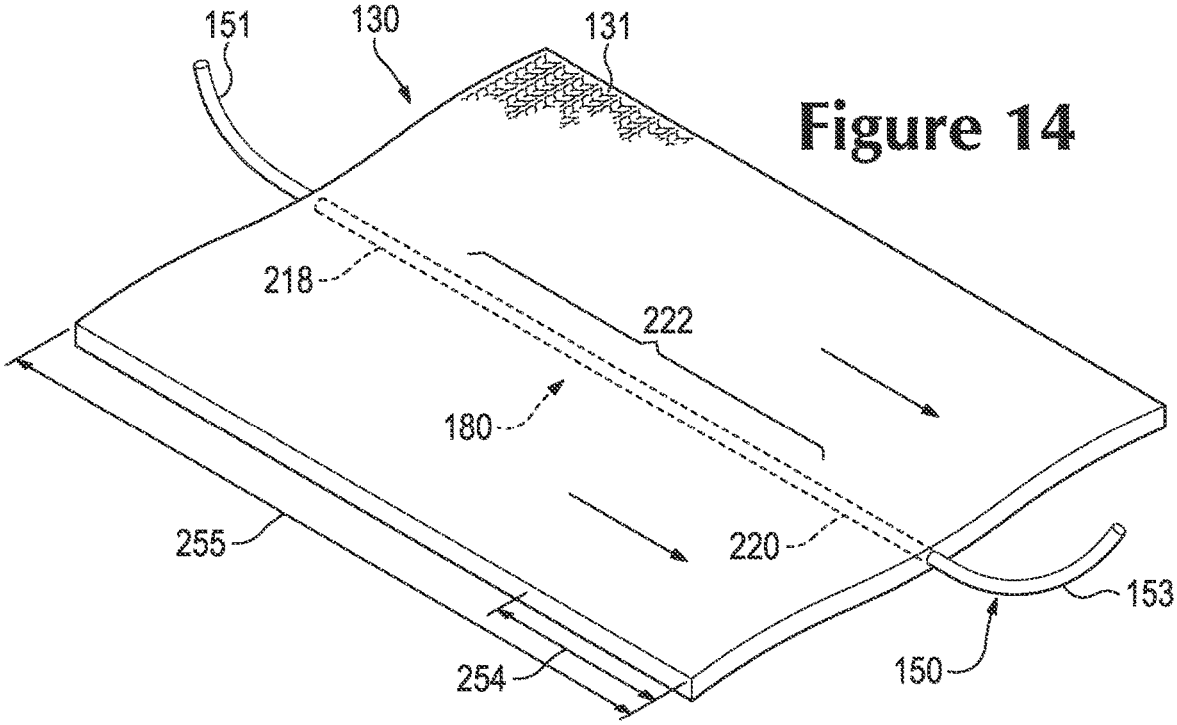
FIG. 14 is a perspective view of the stretch limiter element of FIG. 13 shown in the taut position to prevent further stretching of the knit element.

In some embodiments, stretch limiter element 180 can be adjusted from first slack position of FIG. 11 to second slack position of FIG. 13 by pulling first end 151 and/or second end 153 relative to the other. For example, the wearer can pull both first end 151 and second end 153 away from each other to adjust the slack position of stretch limiter element 180.

Also, in some embodiments, stretch limiter element 180 can have one or more dimensions that are different in the first slack position as compared to the second slack position. For example, in the first slack position of FIG. 11, intermediate section 222 of stretch limiter element 180 can have a first length 244. Also, stretch limiter element 180 can have a first width 246. In contrast, in the second slack position of FIG. 13, stretch limiter element 180 can have a second length 248 and a second width 250. As shown, first length 244 can be greater than second length 248, and first width 246 can be greater than second width 250. In the embodiments illustrated in FIGS. 11 and 13, the zig-zag shape of stretch element 180 is generally the same in the first and second slack positions; however, the overall dimensions change. In other embodiments, the shape of stretch limiter element 180 changes as stretch limiter element 180 moves from the first slack position to the second slack position. For example, in some embodiments, the angles between one or more transverse sections 223, 226, 230, 242 changes and/or the radius of the turns 224, 228, 240 changes. By changing these dimensions, the user can vary the amount of available slack within tensile strand 150. Thus, the available range of stretching of knit element 131 can be changed.

Once stretch limiter element 180 has been adjusted to either the first slack position or the second slack position, the user can secure tensile strand 150 in the selected slack position. For example, stretch limiter element 180 can be secured in the first and/or second slack position by tying first end 151 and second end 153 of tensile strand 150 together as shown in FIG. 5. In other embodiments, a clamp or similar implement can be used to secure the tensile strand 150 with the desired amount of slack.

Figure 19:
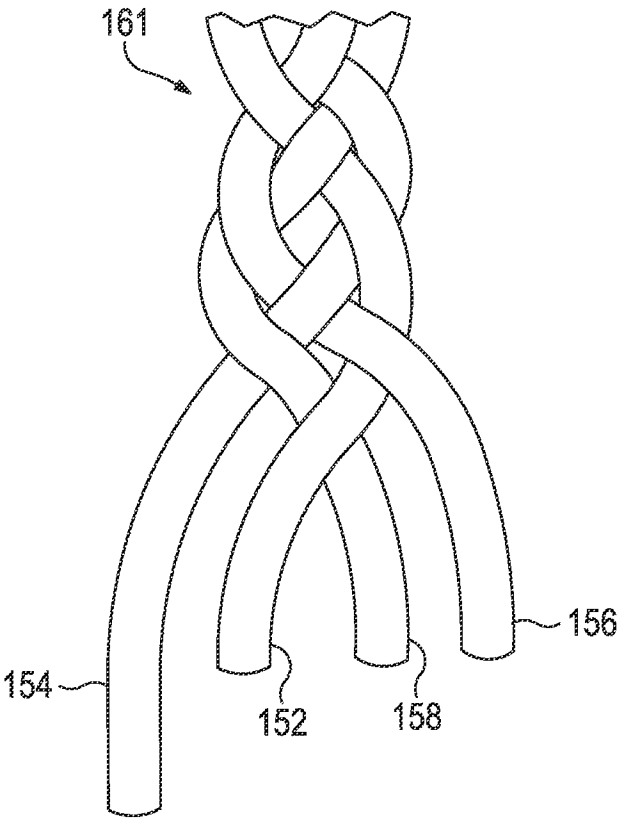
FIG. 19 is a detail view of the tensile strands of FIG. 18 shown further braided.
Figure 18:
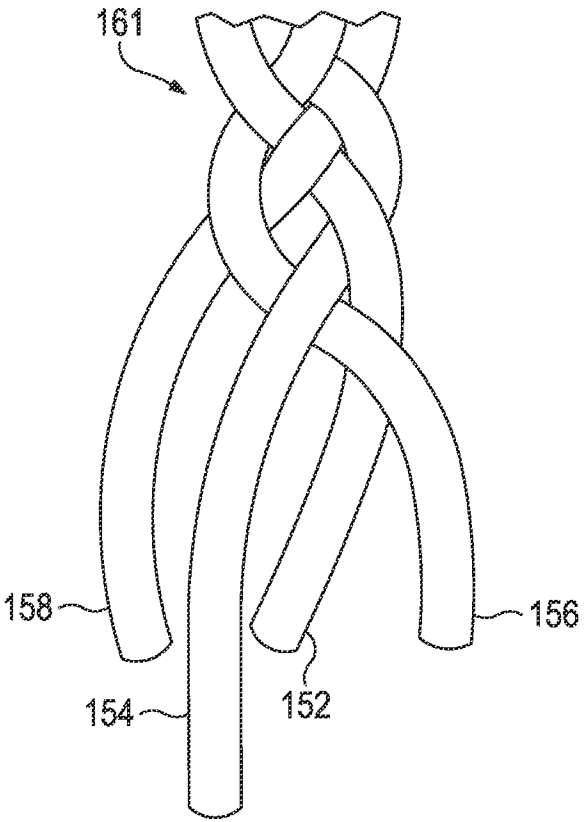
FIG. 18 is a detail view of the tensile strands of FIG. 17 shown being braided.
Figure 17:
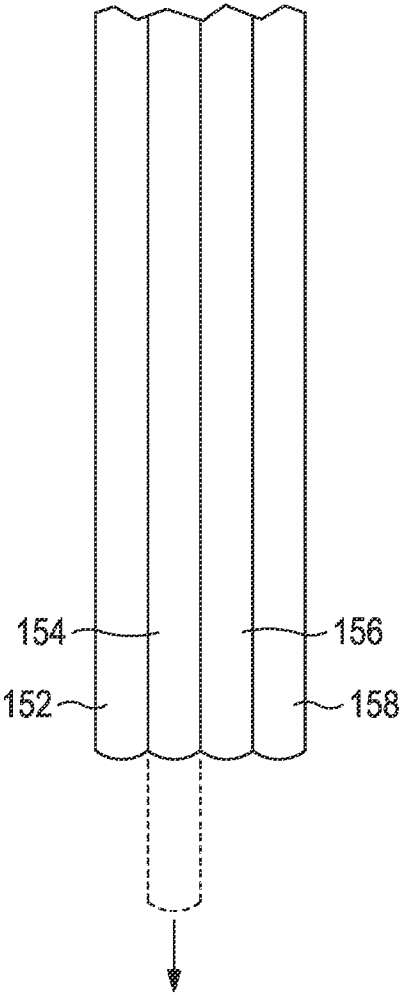
FIG. 17 is a detail view of a plurality of tensile strands of the knitted component of FIG. 5, wherein the tensile strands are shown unbraided, and wherein one of the tensile strands is shown being adjusted relative to the others.

Also, in some embodiments, tensile strand 150 can be secured with the desired amount of slack via the braiding discussed above. For example, as shown in FIGS. 17-19, first tensile strand 152, second tensile strand 154, third tensile strand 156, and fourth tensile strands 158 are shown as representative examples. First tensile strand 152, second tensile strand 154, third tensile strand 156, and fourth tensile strand 158 can be braided as illustrated in FIGS. 18 and 19. However, if the user wishes to change the slack position of one of the strands, the user can unbraid the strands and adjust one relative to the others. In the embodiment of FIG. 17, the second tensile strand 154 has been pulled as represented with broken lines. Then, the user can re-braid the strands as shown in FIGS. 18 and 19. It will be appreciated that the friction between first tensile strand 152, second tensile strand 154, third tensile strand 156, and fourth tensile strand 158 can maintain the desired amount of slack within each. In additional embodiments, a clamp, fastener, adhesives, or other device can be used to maintain the desired amount of slack in the strands.

It will also be appreciated that the user can adjust the stretch characteristics of one portion of knit element 131 relative to another. For example, the user may desire for heel region 102 and midfoot region 103 to have a relatively small range of stretching and for forefoot region 104 to have a relatively large range of stretching. Accordingly, in some embodiments, the user can adjust stretch limiter elements 180 of forefoot tensile strands 115 (namely, limiter elements 182, 184, 186, 188, 190, 192, 194, 196) to the first slack position. In contrast, the user can adjust stretch limiter elements 180 of midfoot tensile strands 116 and heel tensile strands 117 (namely, limiter elements 198, 200, 202, 204, 206, 208, 210, 212, 214, 216) to the second slack position. It will be appreciated that this is merely one example, and any of stretch limiter elements 180 can be adjusted relative to the others to affect the range of stretching within that portion of knit element 131.

Figure 20:
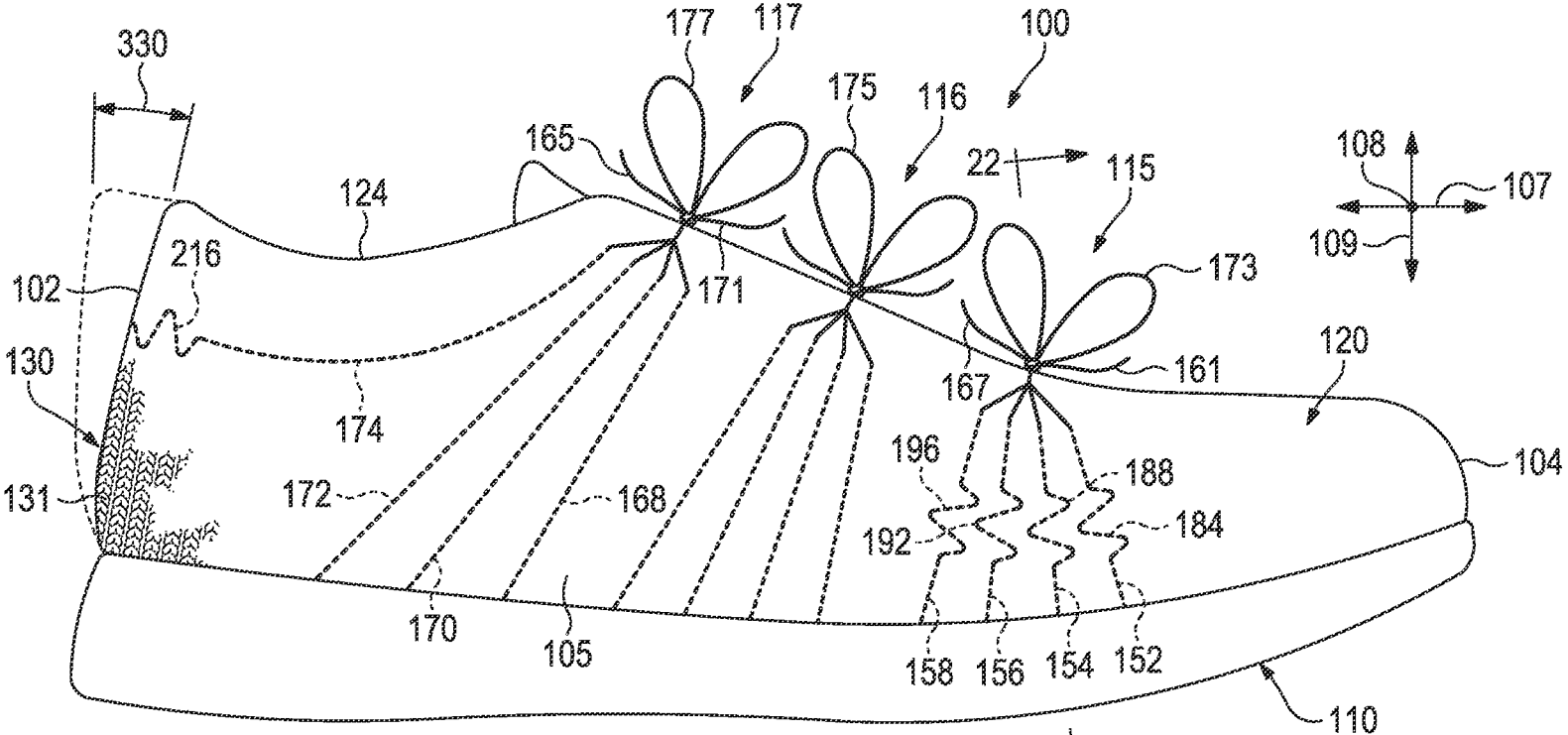
FIG. 20 is a medial side view of the article of footwear of FIG. 5, wherein tensile strands allow for a relatively large range of stretching of the heel region.
Figure 21:
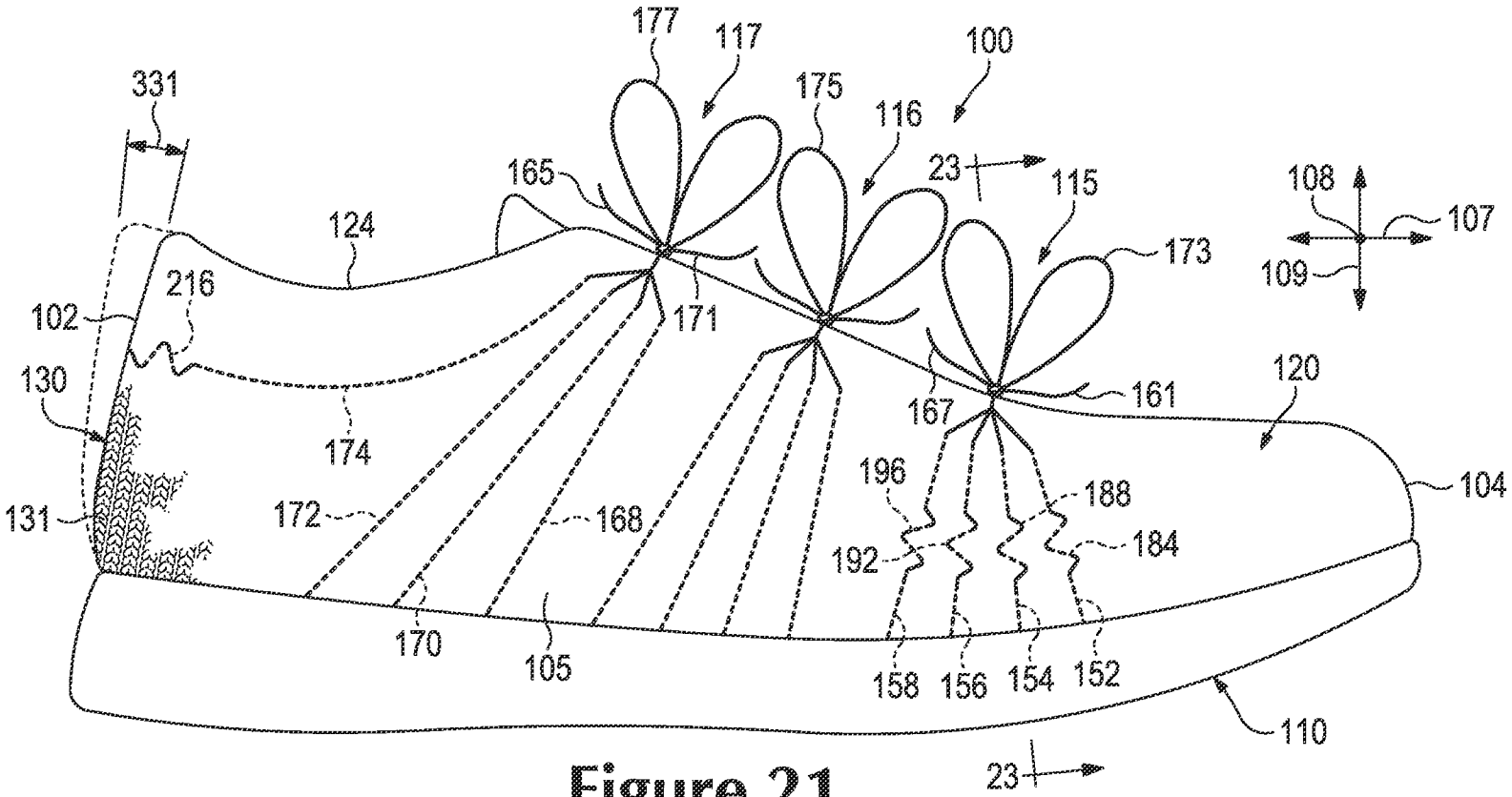
FIG. 21 is a medial side view of the article of footwear of FIG. 5, wherein tensile strands allow for a relatively small range of stretching of the heel region.

FIGS. 20 and 21 further illustrate this concept. As shown in FIG. 20, one or more stretch limiter elements 180 of heel tensile strands 117 can be adjusted for changing the range of available stretching of heel region 102. For example, one or more stretch limiter elements 180 of heel tensile strands 117 can be in the first slack position as shown in FIG. 20. In contrast, the same stretch limiter element(s) 180 can be in the second slack position as shown in FIG. 21. As a result, heel region 102 can stretch in both configurations, for example, due to flexure of the wearer's foot. Specifically, heel region 102 can stretch within a first range of stretching 330 as shown in FIG. 20, and heel region 102 can stretch within a second, smaller range of stretching 331 as shown in FIG. 21.

It will be appreciated that stretch limiter elements 180 of heel tensile strands 117 can be moved from the first slack position to the second slack position in various ways. For example, stretch characteristics of heel region 102 can be changed by adjusting each stretch limiter element 180 of heel tensile strands 117. Alternatively, stretch characteristics in more discreet areas of heel region 102 can be changed by adjusting only some of stretch limiter elements 180 of heel tensile strands 117.

More specifically, to change stretch characteristics of most or all of heel region 102, thirteenth stretch limiter element 206, fourteenth stretch limiter element 208, fifteenth stretch limiter element 210, sixteenth stretch limiter element 212, seventeenth stretch limiter element 214, and eighteenth stretch limiter element 216 can be adjusted collectively. For example, to change these stretch limiter elements 206, 208, 210, 212, 214, 216 from the first slack position to the second slack position, the ends of heel tensile strands 117 can be pulled and secured at the desired tension with third tie 177. Conversely, stretch limiter elements 206, 208, 210, 212, 214, 216 can be adjusted from the second slack position to the first slack position by untying third tie 177, loosening heel tensile strands 117, and re-tying third tie 177 at the desired tension.

To change stretch characteristics of a smaller area of heel region 102, individual ones of stretch limiter elements 206, 208, 210, 212, 214, 216 can be independently adjusted between the first and second slack positions. As an example, it will be assumed that footwear 100 is configured as shown in FIG. 20 and that the wearer desires less stretchability in heel region 102 along longitudinal axis 107. To begin this process, third tie 177 can be untied, and twelfth tensile strand 174 can be unbraided from third medial braid 165 and third lateral braid 171. Next, the ends of twelfth tensile strand 174 can be pulled, causing eighteenth stretch limiter element 216 to move from the first slack position of FIG. 20 to the second slack position of FIG. 21. Subsequently, twelfth tensile strand 174 can be re-braided into third medial braid 165 and third lateral braid 171, and third tie 177 can be re-tied. As a result, the range of stretching of heel region 102 can change from first range 330 shown in FIG. 20 to the second, smaller range 331 shown in FIG. 21. It will be appreciated that any other tensile strand 150 of footwear 100 can be individually adjusted in a corresponding manner. Thus, stretching characteristics in specific and distinct zones of upper 120 can be adjusted and tailored to the wearer's desires.

Figure 22:
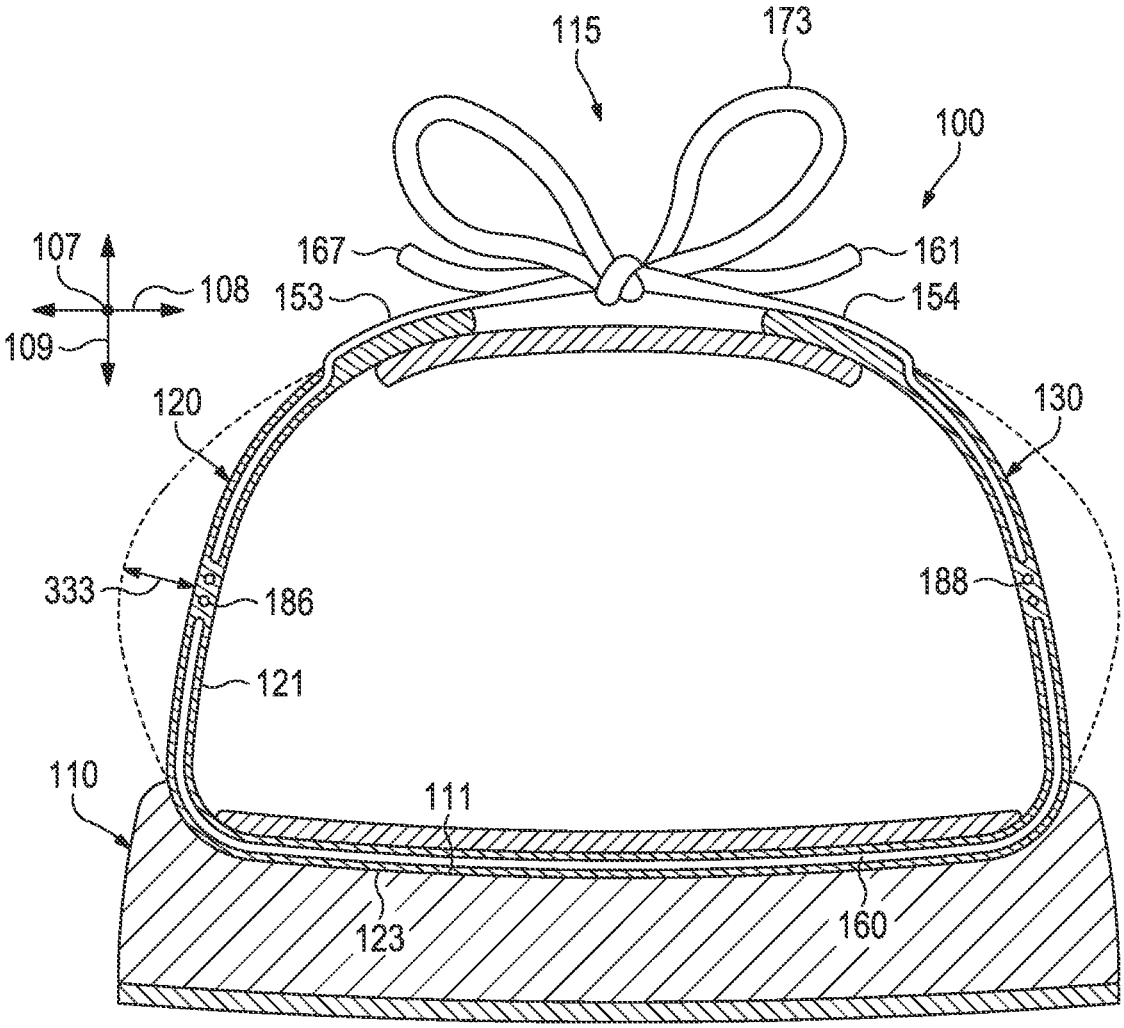
FIG. 22 is a section view of the article of footwear taken along the line 22-22 of FIG. 20, wherein a tensile strand allows for a relatively large range of stretching of the forefoot region.

FIGS. 20-23 further illustrate these concepts with regard to forefoot tensile strands 115. As shown in FIGS. 20 and 22, one or more stretch limiter elements 180 of forefoot tensile strands 115 can be in the first slack position, allowing for a relatively high range of stretching in forefoot region 104. Conversely, in FIGS. 21 and 23, one or more forefoot tensile strands 115 can be in the second slack position, allowing for a relatively low range of stretching in forefoot region 104.

Figure 23:
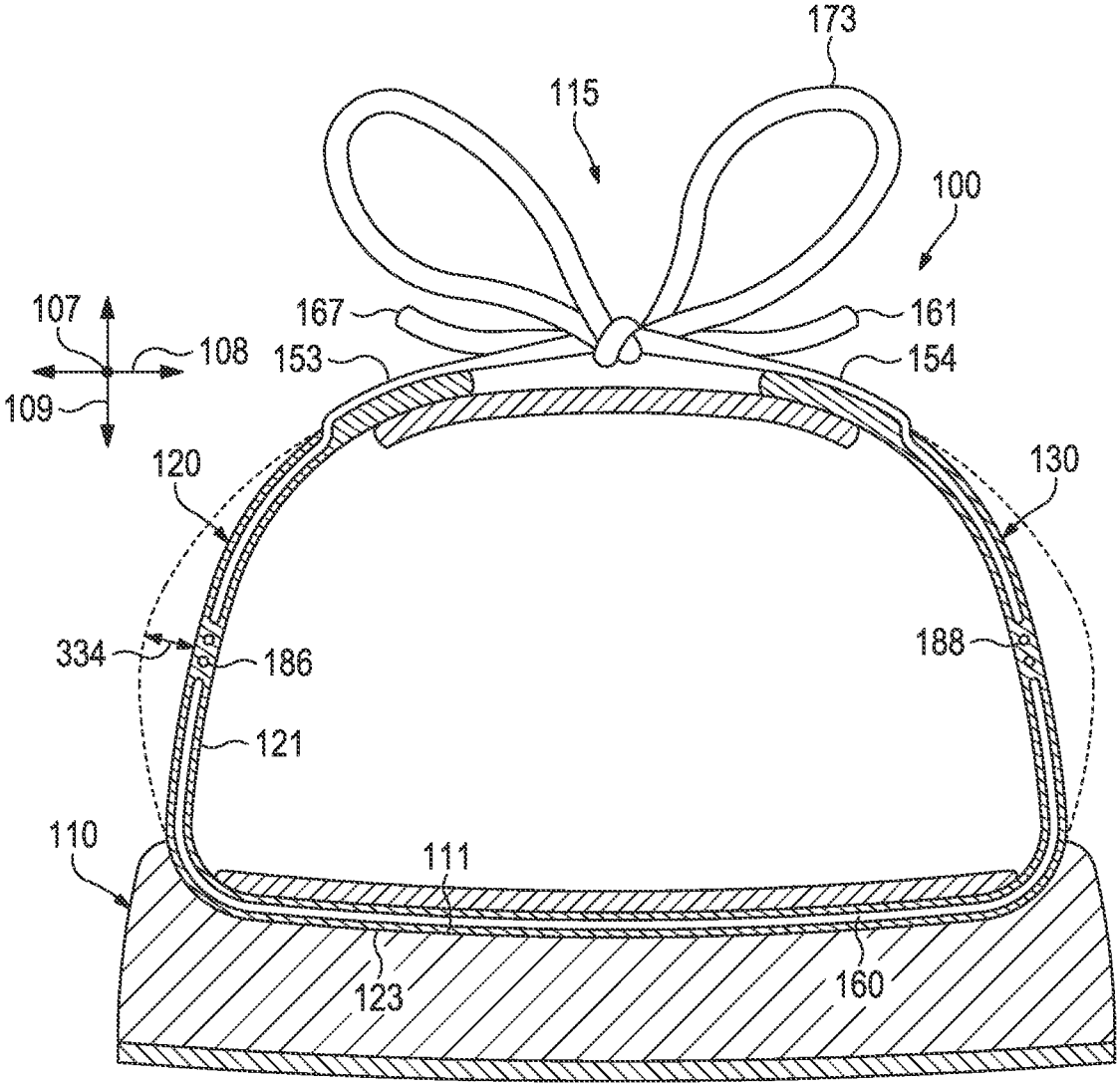
FIG. 23 is a section view of the article of footwear taken along the line 23-23 of FIG. 21, wherein a tensile strand allows for a relatively small range of stretching of the forefoot region.

In some embodiments, stretch limiter elements 180 of forefoot tensile strands 115 can affect stretching generally along the transverse axis 108 as shown in FIGS. 22 and 23. More specifically, this is illustrated in FIGS. 22 and 23 in relation to third stretch limiter element 186 and fourth stretch limiter element 188 of second tensile strand 154. As shown in FIG. 22, third and fourth stretch limiter elements 186, 188 can be disposed in the first slack position to allow for a first range of stretching 333 along transverse axis 108. Conversely, as shown in FIG. 23, third and fourth stretch limiter elements 186, 188 can be disposed in the second slack position to allow for a second, smaller range of stretching 334 along transverse axis 108.

It will be appreciated that third and fourth stretch limiter elements 186, 188 of second tensile strand 154 can be adjusted independent of the other stretch limiter elements 180 of the other forefoot tensile strands 115. This can be achieved, in some embodiments, by untying first tie 173, unbraiding second tensile strand 154 from first medial braid 161 and first lateral braid 167, adjusting the tension of second tensile strand 154, and then re-braiding and re-tying first tie 173 at the desired tension. As such, stretching in a relatively small area of forefoot region 104 can be adjusted.

Also, in some embodiments, each of the forefoot tensile strands 115 can be adjusted together. This can be achieved, in some embodiments, by untying first tie 173, adjusting the tension in forefoot tensile strands 115 while braided in first medial braid 161 and first lateral braid 167, and re-tying first tie 173.

Moreover, midfoot tensile strands 116 can be adjusted for varying the stretching of midfoot region 103. This can be achieved in substantially the same way as described above. Thus, individual ones of the stretch limiter elements 180 of the midfoot tensile strands 116 can be adjusted independently or they can be adjusted as a group.

Accordingly, knitted component 130 can allow the wearer to modify and tailor the upper 120 in a wide variety of ways. The wearer can adjust the fit and stretching behavior of many areas of upper 120 such that upper 120 fits securely and comfortably. Also, upper 120 can be adjusted based on the type of activity of the wearer. For example, if footwear 100 is being worn during running, the wearer may want the forefoot region 104 to have a high range of stretching to allow a large amount of flexure of the foot and toes. In contrast, if footwear 100 is being worn for playing soccer, the wearer may want the forefoot region 104 to have a low range of stretching such that kicking energy transfers readily to the ball. Moreover, in some embodiments, the footwear 100 may be too tight on a specific area of the wearer's foot. To correct this issue, the wearer can adjust the corresponding tensile strand 150 to allow more stretching at that area.

ADDITIONAL EMBODIMENTS

FIGS. 24-31 illustrate additional embodiments of the present disclosure. These embodiments can share features that are similar to the embodiments discussed above. These embodiments also can include additional features.

Figure 24:
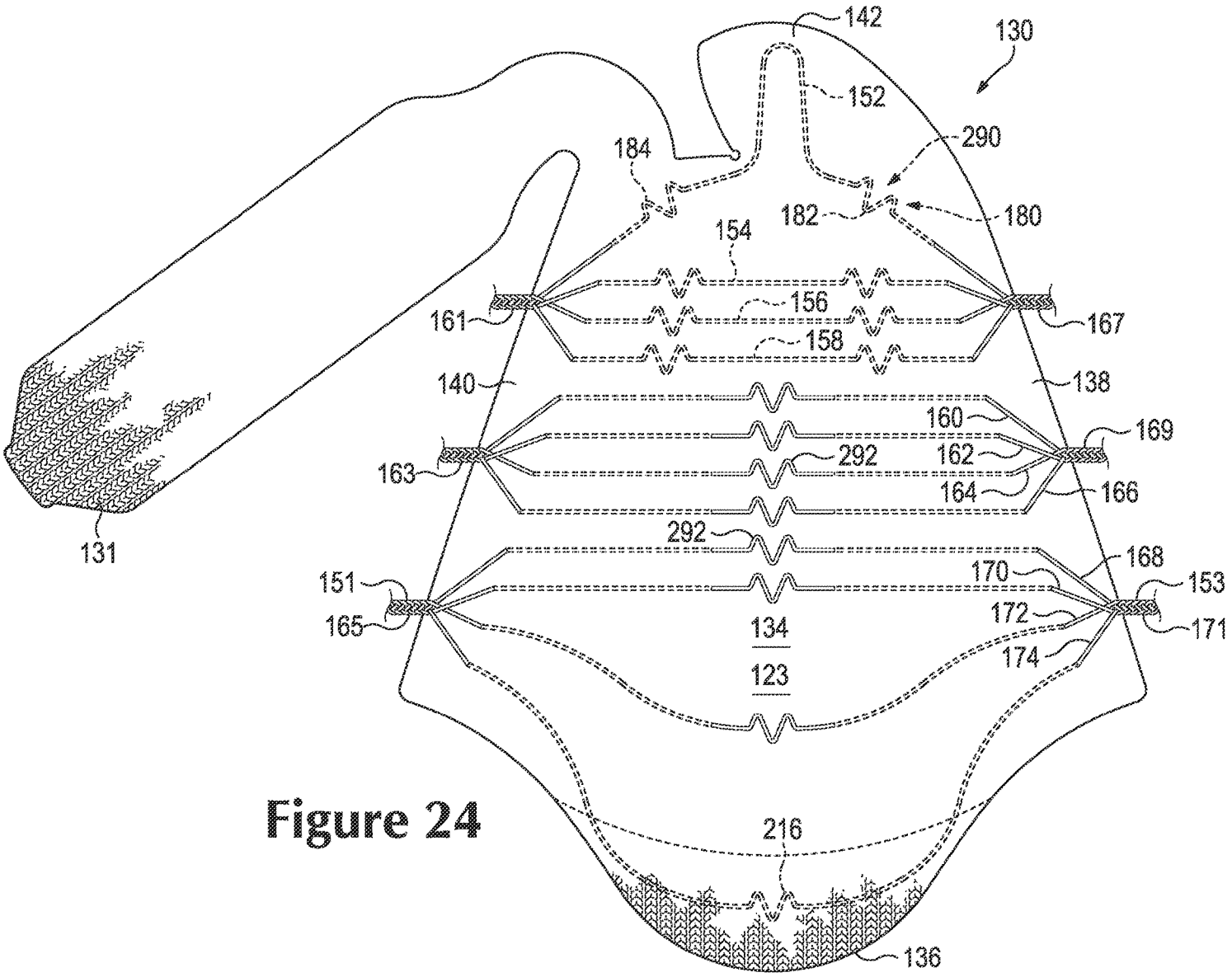
FIG. 24 is a plan view of a knitted component according to additional embodiments of the present disclosure.

As shown in FIG. 24, knitted component 130 can include knit element 131 and a plurality of tensile strands 150. More specifically, tensile strands 150 can comprise first tensile strand 152, second tensile strand 154, third tensile strand 156, fourth tensile strand 158, fifth tensile strand 160, sixth tensile strand 162, seventh tensile strand 164, eighth tensile strand 166, ninth tensile strand 168, tenth tensile strand 170, eleventh tensile strand 172, and twelfth tensile strand 174. These tensile strands 150 can share similar features with the embodiments of FIGS. 5-17. However, in some embodiments, one or more of these tensile strands 150 can be routed differently across knit element 131.

Figure 25:
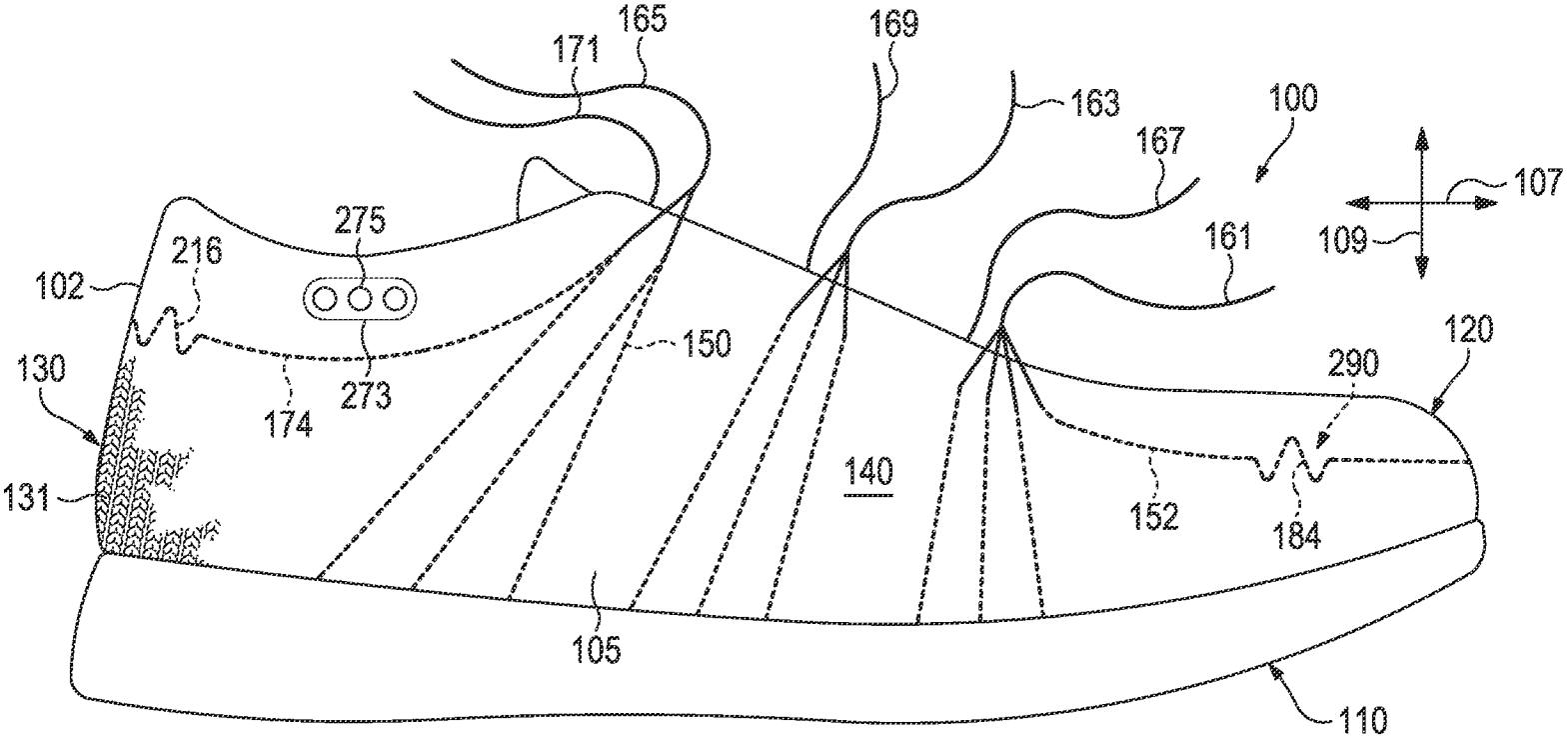
FIG. 25 is a medial side view of an article of footwear with the knitted component of FIG. 24, wherein the tensile strands are shown partially unbraided.

For example, as shown in FIG. 24, first tensile strand 152 can be routed between medial portion 140 and lateral portion 138. First tensile strand 152 can also extend through forefoot portion 142. When knit component 130 is assembled and incorporated within footwear 100 as shown in FIG. 25, sections of first tensile strand 152 can extend substantially along the longitudinal axis 107 and through forefoot region 104 of upper 120. Other tensile strands 150 can be routed similar to the embodiments described with respect to FIGS. 5-10. It will be appreciated, however, that tensile strands 150 can extend across any area of knit element 131 without departing from the scope of the present disclosure.

Furthermore, as shown in FIG. 24, one or more stretch limiter elements 180 can be inlaid within knit element 131 as discussed above. By way of example, first limiter element 182 and second limiter element 184 of first tensile strand 152 can be inlaid within courses and/or wales of knit element 131. As such, these limiter elements can be referred to as inlaid limiter elements 290.

In contrast, in some embodiments, one or more stretch limiter elements 180 can be exposed from knit element 131. As such, these limiter elements can be referred to as exposed limiter elements 292. For example, as shown in FIG. 24, fifth tensile strand 160, sixth tensile strand 162, seventh tensile strand 164, eighth tensile strand 166, ninth tensile strand 168, tenth tensile strand 170, and eleventh tensile strand 172 can include respective exposed limiter elements 292.

Referring to tenth tensile strand 170 as a representative example, exposed limiter element 292 can be disposed on exterior surface 123 of knit element 131 in some embodiments. Also, in some embodiments, exposed limiter element 292 can be disposed on or proximate base portion 134 of knit element 131. Other sections of tenth tensile strand 170 can be inlaid within courses and/or wales of knit element 131 as shown in FIG. 24.

Moreover, first ends 151 of tensile strands 150 can extend away from medial portion 140 of knit element 131, and second ends 153 can extend away from lateral portion 138. First ends 151 and second ends 153 can also be bundled or gathered and secured together in various ways. For example, first ends 151 can be braided to other first ends 151 in some embodiments, and second ends 153 can be braided to other second ends 153. Thus, as shown in FIGS. 24 and 25, knitted component 130 can include first medial braid 161, second medial braid 163, third medial braid 165, first lateral braid 167, second lateral braid 169, and third lateral braid 171, similar to the embodiments discussed above.

Figure 26:
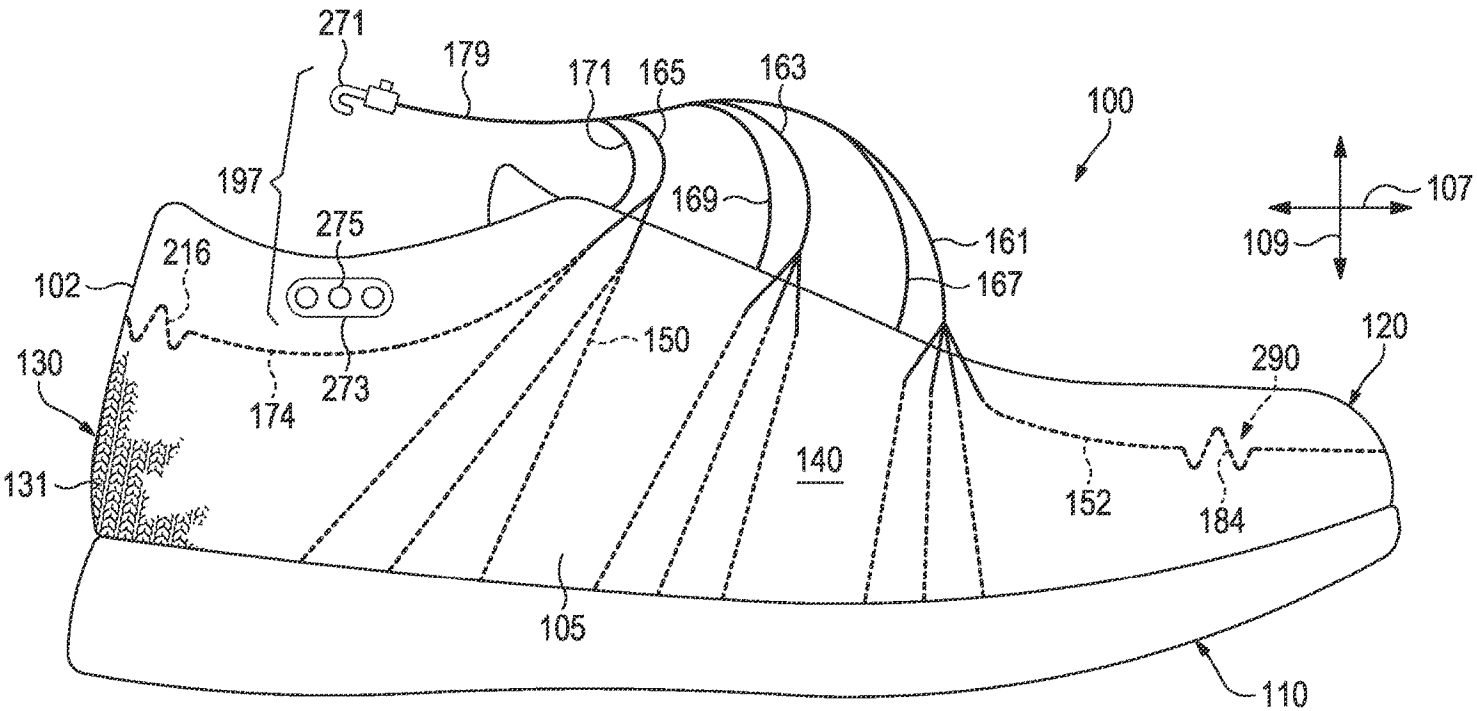
FIG. 26 is a medial side view of the article of footwear of FIG. 25, wherein the tensile strands are shown braided and attached to a securement device, wherein the securement device is shown in an unsecured position.

Moreover, in some embodiments, one or more braids can be gathered, bunched, or otherwise collected and secured together. For example, as shown in FIG. 26, first medial braid 161, second medial braid 163, third medial braid 165, first lateral braid 167, second lateral braid 169, and third lateral braid 171 can be gathered and secured together in some embodiments. For example, these braids can be braided together into a main braid 179.

Main braid 179 can be further secured to upper 120 or to sole structure 110 to maintain desired tension in tensile strands 150. For example, in some embodiments, main braid 179 can wrap around heel region 102 and can be secured to medial side 105 of upper 120.

Figure 27:
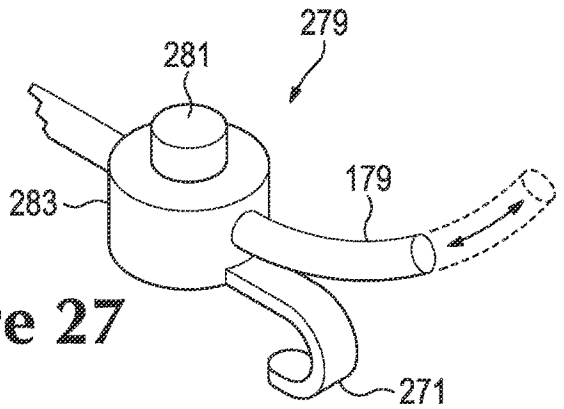
FIG. 27 is a detail view of the securement device of FIG. 26.
Figure 28:
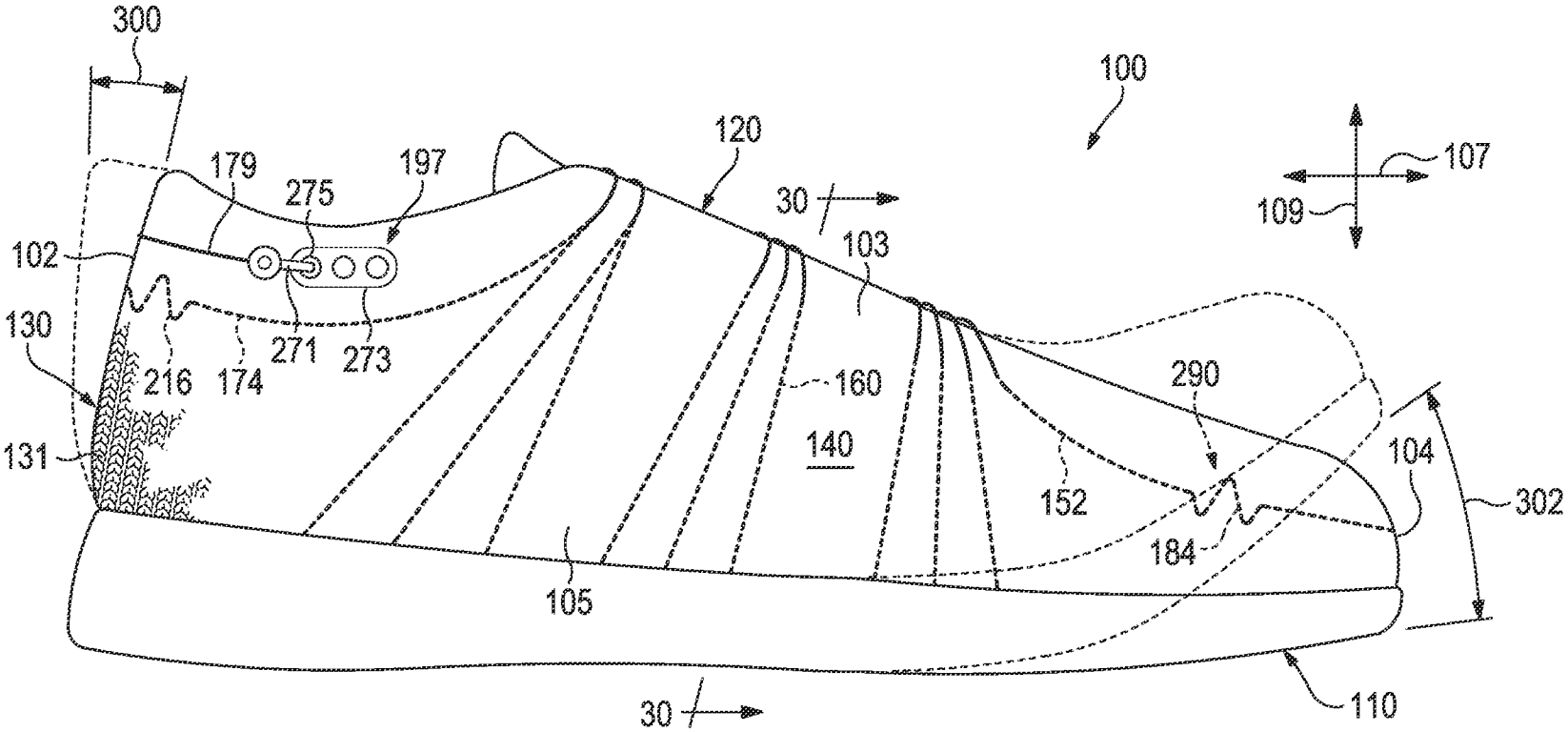
FIG. 28 is a medial side view of the article of footwear of FIG. 25, wherein the securement device is shown in a first secured position.
Figure 29:
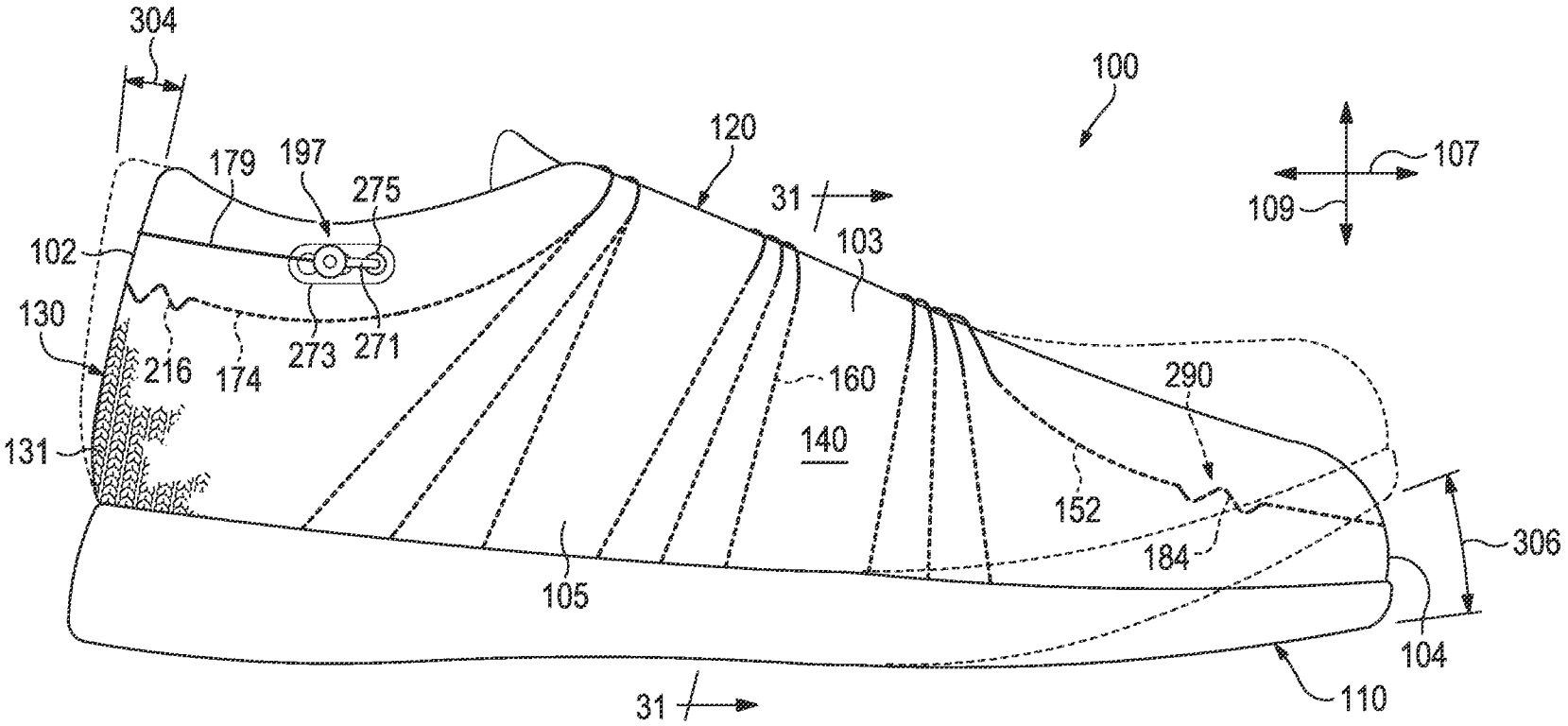
FIG. 29 is a medial side view of the article of footwear of FIG. 25, wherein the securement device is shown in a second secured position.

Additionally, footwear 100 can include a securement device 197 for securing main braid 179 as indicated in FIGS. 26, 28, and 29. In some embodiments, securement device 197 can include a fastener, adhesive, or other type. In some embodiments, securement device 197 can include a hook 271 and a retainer 273 that receives the hook 272. Additionally, as shown in FIG. 27, hook 271 can be attached to a clamp 279 that attaches main braid 179 to hook 272.

Retainer 273 can include one or more openings 275, each configured to receive hook 272. For example, as shown in FIG. 26, retainer 273 can include three openings 275 in some embodiments. In some embodiments, retainer 273 can be included on upper 120. For example, retainer 273 can be disposed on medial side 105. Openings 275 can be aligned generally parallel to longitudinal axis 107.

As shown in FIG. 26, hook 271 can have an unsecured position, in which hook 271 is spaced away from retainer 273 and is disposed outside openings 275. In contrast, as shown in FIG. 28, hook 271 can have a secured position, in which hook 271 is disposed within opening 275. As shown in FIG. 28, hook 271 can have a first secured position where hook 271 is received within opening 273 nearest heel region 102. Also, as shown in FIG. 29, hook 271 can have a second secured position where hook 271 is received within opening 273 spaced further away from heel region 102. Thus, the tension in tensile strands 150 can be adjusted by moving hook 271 between the different openings 275 of retainer 273.

Also, in some embodiments, clamp 279 can be an adjustable clamp that can be used for changing tension in tensile strands 150. For example, as shown in FIG. 27, clamp 279 can include a housing 283 that receives main braid 179. Main braid 179 can be fixed relative to housing 283. Clamp 279 can also include a selector 281, such as a button. By pushing selector 281, the wearer can temporarily release main braid 179 from housing 283 and advance main braid 179 relative to housing as shown with broken lines in FIG. 27.

As discussed above with reference to FIGS. 11 and 13, tensile strands 150 and stretch limiter elements 180 can be adjusted. Thus, stretch limiter elements 180 with more slack can allow more stretching than stretch limiter elements 180 with less slack.

Likewise, in the embodiments of FIGS. 25-29, the slack position of stretch limiter elements 180 can be adjusted in one or more ways. For example, the wearer can move the hook 271 between the different openings 275 to change the slack position of tensile strands 150. Also, the wearer can advance the main braid 179 relative to the clamp 279 to change the slack position of stretch limiter elements 180. Individual limiter elements 180 can also be adjusted as well. For example, in some embodiments, one or more tensile strands 150 can be removed from the respective braid, advanced relative to the other tensile strands 150, and then re-braided and attached to hook 271. Hook 271 can then be re-hooked into retainer 273.

Accordingly, stretching characteristics of footwear 100 can be selectable and adjusted with precision. For example, in the embodiment of FIG. 28, heel region 102 can stretch within range 300 and forefoot region 104 can stretch within range 302. Stated differently, stretch limiter element 184 of first tensile strand 152 can allow stretching of forefoot region 104 within range 302. Also, stretch limiter element 216 of twelfth tensile strand 174 can allow stretching of heel region 102 within range 300. To adjust these stretching characteristics, the user can unbraid main braid 179 and any other necessary braids. Then, the wearer can advance first tensile strand 152 and twelfth tensile strand 174 relative to the other tensile strands 150. Next, the wearer can re-braid tensile strands 150, reattach main braid 179 to clamp 279, and reattach hook 271 to retainer 273. As a result, heel region 102 can stretch within reduced range 304 and forefoot region 104 can stretch within reduced range 306 as shown in the embodiment of FIG. 29. It will be appreciated that other tensile strands 150 can be adjusted in a similar manner.

Furthermore, in some embodiments, one or more tensile strands 150 and stretch limiter elements 180 can be attached to sole structure 110. Accordingly, in some embodiments, tensile strands 150 can affect stretching characteristics of sole structure 110.

Figure 30:
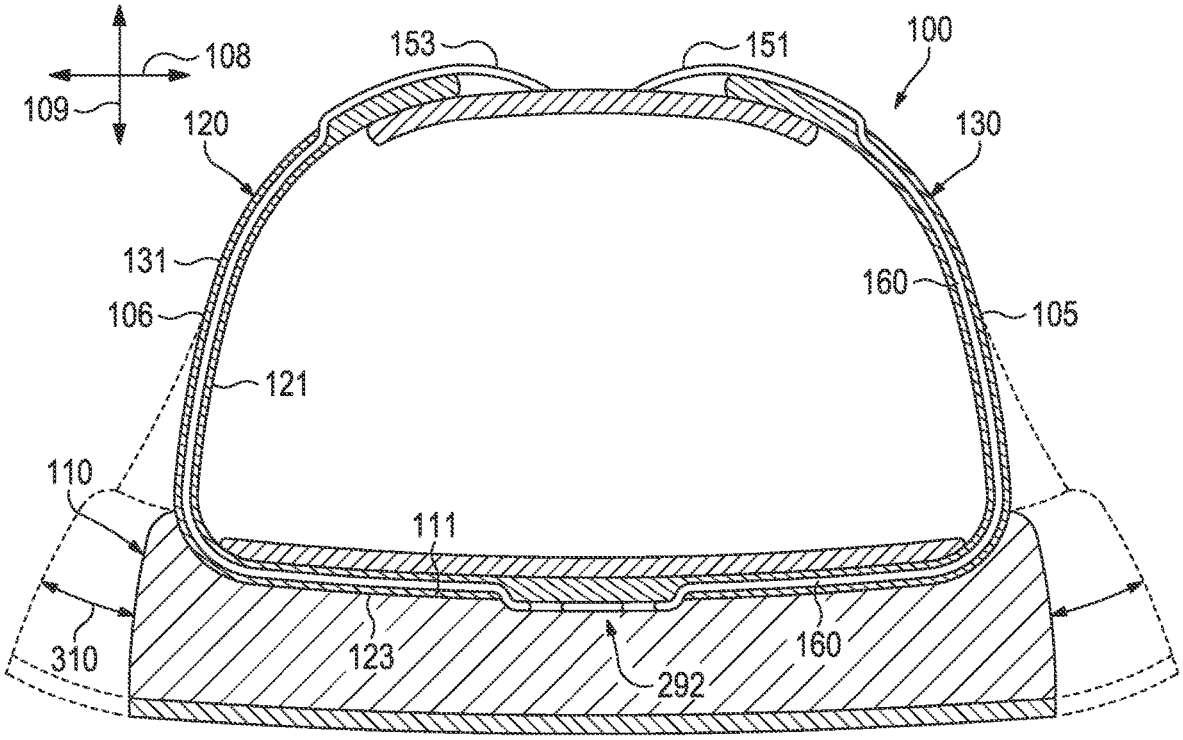
FIG. 30 is a section view of the article of footwear taken along the line 30-30 of FIG. 28.
Figure 31:
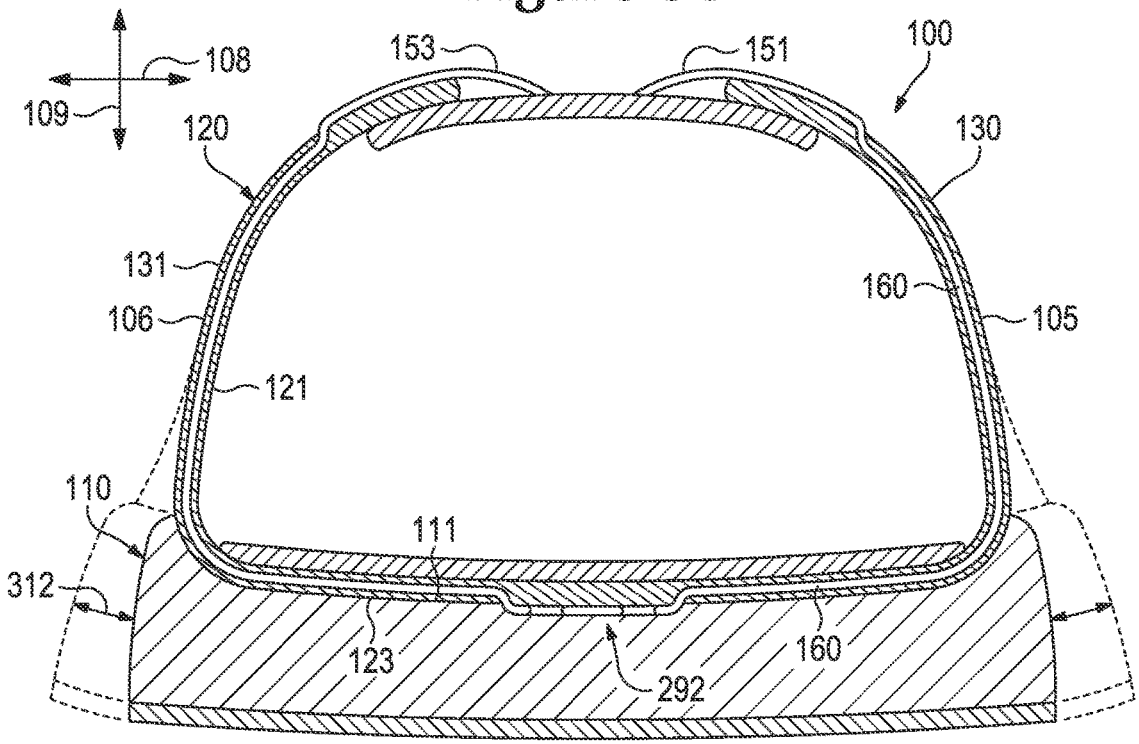
FIG. 31 is a section view of the article of footwear taken along the line 31-31 of FIG. 29.

More specifically, FIGS. 30 and 31, illustrate exposed limiter element 292 of fifth tensile strand 160 as a representative example. As shown, fifth tensile strand 160 can extend between medial side 105 and lateral side 106, and exposed stretch limiter element 292 can be exposed from exterior surface 123 of knit element 131 in some embodiments. Also, exposed stretch limiter element 292 can be attached to upper surface 111 of sole structure 110.

Accordingly, as shown in FIG. 30, sole structure 110 can stretch with knit element 131 as stretch limiter element 292 moves between the slack position and the taut position. For example, as shown in FIG. 30, knit element 131 and sole structure 110 can stretch in concert substantially along transverse axis 108 in some embodiments. Specifically, when stretch limiter element 292 is in the slack position, knit element 131 and sole structure 110 can be relatively narrow as shown with solid lines in FIG. 30. However, sole structure 110 and knit element 131 can stretch in width as represented with broken lines. Once stretch limiter element 292 reaches its taut position, stretch limiter element 292 can prevent further stretching. Thus, sole structure 110 and knit element 131 can stretch within a first range 310 as shown in FIG. 30.

Additionally, in some embodiments, the wearer can adjust the slack position of stretch limiter element 292 as represented in FIG. 31. Thus, like the embodiments discussed above, the wearer can adjust the slack position of stretch limiter element 292 by pulling on ends 151 and 153 and re-securing ends. As a result, knit element 131 and sole structure 110 can stretch within a second range 312 as shown in FIG. 31. It is noted that the second range of stretching 312 is less than first range 310.

In some embodiments, sole structure 110 can be highly stretchable to allow for this type of stretching behavior. For example, in some embodiments, sole structure 110 can include highly elastic and resilient material.

Figure 32:
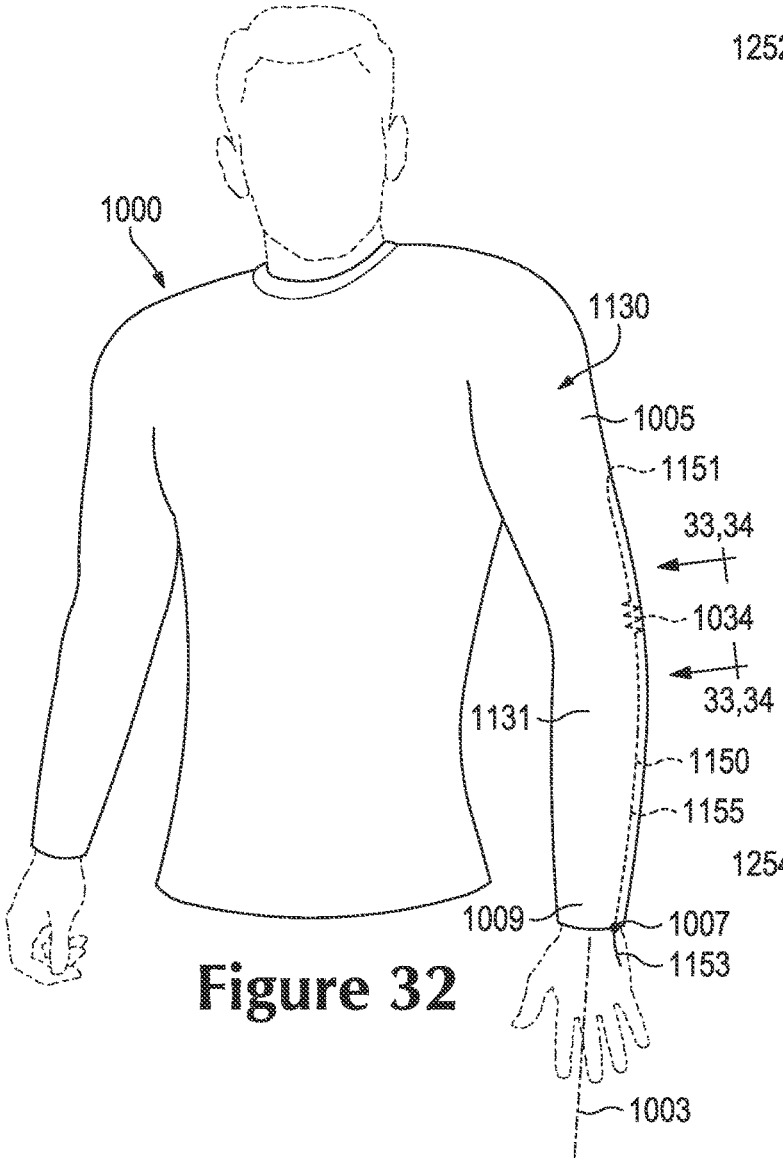
FIG. 32 is a perspective view of an article of apparel with a knit element and a stretch limiter element according to additional embodiments of the present disclosure.
Figure 33:
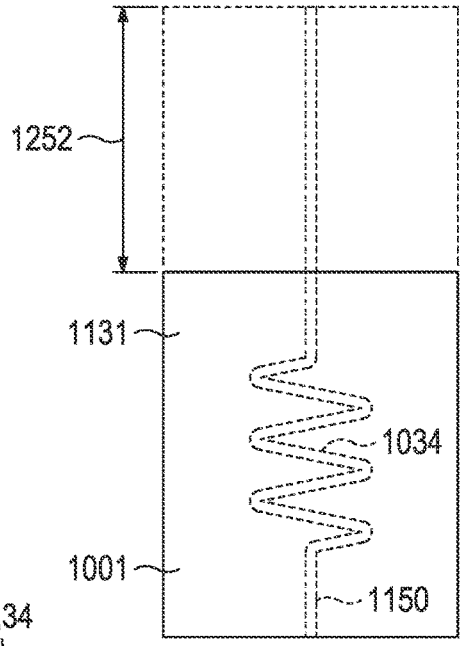
FIG. 33 is a detail view of an area of the article of apparel taken from the perspective of line 33-33 of FIG. 32.
Figure 34:
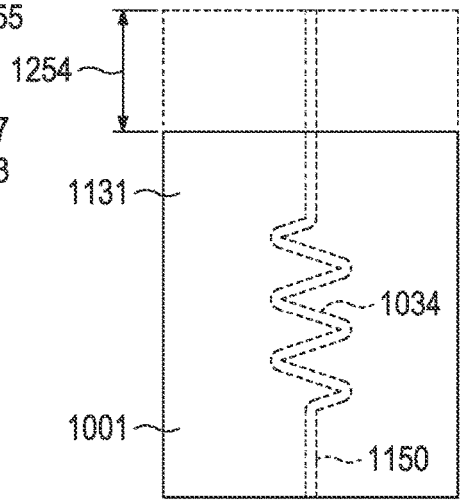
FIG. 34 is a detail view of the area of the article of apparel taken from the perspective of line 34-34 of FIG. 32.

Referring now to FIGS. 32-34, additional embodiments of the present disclosure are illustrated. As shown, an article of apparel 1000 can incorporate a knitted component 1130 with a stretch limiter element 1034. Stretch limiter element 1034 can be used to adjust the stretch characteristics of one or more areas of apparel 1000, similar to the embodiments discussed above.

As shown in FIG. 32, article of apparel 1000 can be a shirt, sweatshirt, or other article worn on the torso and/or arms. However, it will be appreciated that article of apparel 1000 can be configured for covering other areas of the body. Thus apparel 1000 can be a pair of pants, a sleeve, a wrap, an article that covers the head, or other type.

In some embodiments, knitted component 1130 can define a majority of article of apparel 1000. In other embodiments, knitted component 1130 can define a localized area of apparel 1000.

Moreover, stretch limiter element 1034 can be incorporated in any suitable area of apparel 1000. For example, stretch limiter element 1034 can be incorporated in an area of apparel 1000 proximate an anatomical joint. Thus, element 1034 can affect stretching of apparel 1000 that occurs when the wearer flexes the joint. Also, in some embodiments, element 1034 can be incorporated in an area that stretches due to flexure of the wearer's muscles or other movements. Specifically, as shown in the embodiment of FIG. 32, stretch limiter element 1034 can be incorporated in an area of apparel 1000 that covers the wearer's elbow. As such, apparel 1000 can stretch, for example, due to flexure of the elbow joint, and stretch limiter element 1034 can be used to limit and/or adjust this stretching behavior.

As shown in FIGS. 32-34, knitted component 1130 can include a knit element 1131 and one or more tensile strands 1150. In some embodiments, tensile strand 1150 can include a first end 1151, a second end 1153, and a middle section 1155 that is defined between first end 1151 and second end 1153.

In some embodiments, tensile strand 1150 can extend generally along a longitudinal axis 1003 of a sleeve 1005 of apparel 1000. Also, in some embodiments, first end 1151 can be disposed in a proximal region of sleeve 1005, and second end 1153 can be disposed in a distal region of sleeve 1005.

Tensile strand 1150 can define stretch limiter element 1034. Furthermore, stretch limiter element 1034 can be adjusted between a first slack position and a second slack position. The first slack position is represented in FIG. 33, and the second slack position is represented in FIG. 34 according to exemplary embodiments. Similar to the embodiments discussed above, a reference area 1001 of knit element 1131 can exhibit a greater range of stretching in the first slack position of FIG. 33 as compared to the second slack position of FIG. 34. More specifically, when in the first slack position, reference area 1001 can stretch within a first range 1252, and when in the second slack position, reference area 1001 can stretch within a smaller second range 1254.

Tensile strand 1150 can be manipulated to adjust stretch limiter element 1034 between the first and second slack positions. In some embodiments, first end 1151 and/or second end 1153 can be manipulated to adjust stretch limiter element 1034.

For example, in some embodiments represented in FIG. 32, first end 1151 can be fixed to knit element 1131. In contrast, second end 1153 can be exposed from knit element 1131 and can extend from knit element 1131. The wearer can pull on second end 1153, for example, to adjust stretch limiter element 1034 from the first slack position to the second slack position. Also, in some embodiments, the resilience of knitted component 1130 can cause stretch limiter element 1034 to recover back to the first slack position once the wearer stops pulling on second end 1153.

Additionally, in some embodiments, apparel 1000 can include a securement device 1007. Securement device 1007 can be used to secure tensile strand 1150 and, thus, stretch limiter element 1034 in the selected slack position. Securement device 1007 can include a clamp, a tie, a spool, or other implement that detachably secures tensile strand 1150 to knit element 1131. In the embodiment of FIG. 32, for example, securement device 1007 is shown schematically and is shown adjacent a cuff 1009 of apparel 1000. Securement device 1007 can detachably secure second end 1153 relative to cuff 1009 to maintain stretch limiter element 1034 at the desired position. In additional embodiments, securement device 1007 can be a removable knot formed in tensile strand 1150, and the knot can interfere with cuff 1009 to prevent second end 1153 from sliding into knit element 1131 when sleeve 1005 stretches.

It will be appreciated that apparel 1000 can also include additional tensile strands 1150 with additional stretch limiter elements 1034 at different areas. These stretch limiter elements 1034 can be individually adjusted such that the respective areas of apparel 1000 can exhibit different stretch characteristics.

In summary, knitted components 130, 1130 described herein can be used for controlling the stretching of footwear 100, apparel 1000, or other articles. As such, these articles can stretch to maintain comfort, and the stretching can be limited to ensure the article remains secured to the wearer's body. Also, tensile strands 150, 1150 can be adjusted in some embodiments such that the stretching behavior of one or more areas of the article can be tailored to the wearer's desires. For example, tensile strands 150, 1150 can be arranged in different zones or areas of the article, and different tensile strands 150, 1150 can be adjusted for controlling the amount of stretching that occurs in the different zones.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

We claim:

1. An upper for an article of footwear, the upper comprising:

a knit element that is configured to stretch between a neutral position and a stretched position; and a tensile strand that is at least partially inlaid within the knit element, the tensile strand including a portion that is arranged as a stretch limiter element that is configured to move between a first slack position and a taut position as the knit element moves between the neutral position and the stretched position, wherein the tensile strand is part of a first braid, wherein a main braid is formed from the first braid and one or more additional braids secured together, and the main braid is configured to wrap around a heel region of the upper and to be secured to a medial side of the upper.

2. The upper of claim 1, wherein slack of the tensile strand is adjustable.

3. The upper of claim 2, wherein the knit element is configured to stretch within a first range of stretching motion as the tensile strand moves from the first slack position to the taut position, and wherein the knit element is configured to stretch within a second range of stretching motion as the tensile strand moves from a second slack position to the taut position, wherein the first range of stretching motion is greater than the second range of stretching motion.

4. The upper of claim 1, further comprising a sole structure of the article of footwear, wherein the upper is attached to the sole structure.

5. The upper of claim 4, wherein the sole structure covers the stretch limiter element.

6. The upper of claim 1, wherein the main braid is secured to the medial side using a securement device.

7. The upper of claim 6, wherein the securement device includes a hook.

8. The upper of claim 7, wherein the hook is attached to a clamp that attaches the main braid to the hook.

9. The upper of claim 8, wherein a retainer on the medial side of the upper includes one or more openings configured to receive the hook.

10. The upper of claim 1, wherein the stretch limiter element is inlaid within the knit element.

11. The upper of claim 1, wherein the stretch limiter element extends along a substantially linear path across the knit element when the stretch limiter element is in the taut position, and wherein the stretch limiter element extends along a non-linear path across the knit element when the stretch limiter element is in the first slack position.

12. A knitted component for an upper of an article of footwear, the knitted component comprising:

a knit element that is configured to stretch between a neutral position and a stretched position; and a tensile strand that is at least partially inlaid within the knit element, the tensile strand including a portion that is arranged as a stretch limiter element that is configured to move between a first slack position and a taut position as the knit element moves between the neutral position and the stretched position, wherein the tensile strand is part of a first braid, wherein a main braid is formed from the first braid and one or more additional braids secured together, and the main braid is configured to wrap around a heel region of the upper and to be secured to a medial side of the upper.

13. The knitted component of claim 12, wherein slack of the tensile strand is adjustable.

14. The knitted component of claim 12, wherein the knit element is configured to stretch within a first range of stretching motion as the tensile strand moves from the first slack position to the taut position, and wherein the knit element is configured to stretch within a second range of stretching motion as the tensile strand moves from a second slack position to the taut position, wherein the first range of stretching motion is greater than the second range of stretching motion.

15. The knitted component of claim 12, further comprising a sole structure of the article of footwear, wherein an upper is attached to the sole structure.

16. The knitted component of claim 15, wherein the sole structure covers the stretch limiter element.

17. The knitted component of claim 12, wherein the main braid is secured to the medial side using a securement device.

18. The knitted component of claim 17, wherein the securement device includes a hook.

19. The knitted component of claim 18, wherein the hook is attached to a clamp that attaches the main braid to the hook.

20. The knitted component of claim 18, wherein a retainer on the medial side of the upper includes one or more openings configured to receive the hook.

* * * * *